US012429224B1

(12) United States Patent
Crawley

(10) Patent No.: US 12,429,224 B1
(45) Date of Patent: Sep. 30, 2025

(54) AXIAL FUEL STAGE INJECTOR WITH FUEL INJECTION IN SAME DIRECTION AS HIGH-PRESSURE AIR FLOW

(71) Applicant: GE Infrastructure Technology LLC, Greenville, SC (US)

(72) Inventor: Bradley D. Crawley, Greenville, SC (US)

(73) Assignee: GE Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 18/659,364

(22) Filed: May 9, 2024

(51) Int. Cl.
*F23R 3/34* (2006.01)
*F23R 3/28* (2006.01)
*F23R 3/36* (2006.01)

(52) U.S. Cl.
CPC ..... *F23R 3/346* (2013.01); *F23R 3/286* (2013.01); *F23R 3/36* (2013.01)

(58) Field of Classification Search
CPC ..... F23R 3/34; F23R 3/346
See application file for complete search history.

(56) References Cited

U.S. PATENT DOCUMENTS 10,690,349 B2 * 6/2020 Natarajan ..... F23R 3/286
10,718,523 B2 * 7/2020 Gubba ..... F23D 14/64
11,067,281 B1 * 7/2021 Garcia ..... F23R 3/283
11,333,360 B2 * 5/2022 Garcia ..... F23R 3/34
2010/0229557 A1 * 9/2010 Matsumoto ..... F23R 3/34 60/737
2011/0067402 A1 * 3/2011 Wiebe ..... F23R 3/46 60/740
2011/0296839 A1 * 12/2011 Van Nieuwenhuizen ..... F23R 3/346 60/737
2013/0174558 A1 * 7/2013 Stryapunin ..... F23R 3/002 60/734
2013/0269350 A1 * 10/2013 Khan ..... F23R 3/286 60/737
2013/0283801 A1 * 10/2013 Romig ..... F23R 3/346 60/733
2014/0182294 A1 * 7/2014 Matsumoto ..... F23R 3/286 60/737
2015/0285501 A1 * 10/2015 DiCintio ..... F23R 3/346 60/740
2015/0285504 A1 * 10/2015 Melton ..... B23K 26/702 60/737

(Continued)

*Primary Examiner* — William H Rodriguez
(74) *Attorney, Agent, or Firm* — James Pemrick; Charlotte Wilson; Hoffman Warnick LLC

(57) ABSTRACT

An axial fuel stage (AFS) injector includes a mixing member defining a mixing chamber having an inlet and an outlet in fluid communication with a combustion chamber of the combustor. A high pressure (HP) air-fuel injection member includes at least one row of HP air-fuel injectors for directing an air-fuel mixture into the mixing chamber. Each HP air-fuel injector includes two opposing sidewalls and a middle wall extending longitudinally between the two opposing sidewalls. The middle wall and each opposing sidewall define an elongated HP air jet therebetween. A fuel plenum delivers fuel from a fuel source to fuel injector(s) defined in a radially inner end of the middle wall. Each elongated HP air jet is configured to direct an HP air flow toward the inlet of the mixing chamber from an HP air source in a same direction as a fuel flow from the at least one fuel injector.

20 Claims, 15 Drawing Sheets

(56) References Cited

U.S. PATENT DOCUMENTS

| | | | | |
|---|---|---|---|---|
| 2015/0362194 | A1* | 12/2015 | Ogata | F23R 3/286 60/39.463 |
| 2017/0114717 | A1* | 4/2017 | Martin | F02C 7/22 |
| 2017/0219212 | A1* | 8/2017 | Laster | F02C 3/30 |
| 2017/0268784 | A1* | 9/2017 | Crawley | F23R 3/34 |
| 2017/0268786 | A1* | 9/2017 | Cai | F23R 3/283 |
| 2017/0321609 | A1* | 11/2017 | Ogata | F02C 7/228 |
| 2018/0187607 | A1* | 7/2018 | Hughes | F02C 7/222 |
| 2018/0187893 | A1* | 7/2018 | DiCintio | F23D 14/64 |
| 2018/0187894 | A1* | 7/2018 | Cai | F23D 14/64 |
| 2018/0209651 | A1* | 7/2018 | Cai | F23R 3/346 |
| 2018/0209653 | A1* | 7/2018 | DiCintio | F01D 9/041 |
| 2018/0328587 | A1* | 11/2018 | Gubba | F23R 3/346 |
| 2018/0328588 | A1* | 11/2018 | Lemon | F23R 3/36 |
| 2019/0024899 | A1* | 1/2019 | Patel | F23R 3/346 |
| 2020/0355371 | A1* | 11/2020 | Lind | F23R 3/286 |
| 2021/0348763 | A1* | 11/2021 | Roh | F23R 3/16 |
| 2021/0404660 | A1* | 12/2021 | Godfrey | F23R 3/346 |
| 2022/0099297 | A1* | 3/2022 | Garcia | F23R 3/286 |
| 2024/0183538 | A1* | 6/2024 | Kim | F23R 3/34 |

* cited by examiner

AXIAL FUEL STAGE INJECTOR WITH FUEL INJECTION IN SAME DIRECTION AS HIGH-PRESSURE AIR FLOW

GOVERNMENT RIGHTS

This application was made with government support under contract number DE-FE0032173 awarded by the Department of Energy. The US government has certain rights in the invention.

TECHNICAL FIELD

The disclosure relates generally to turbomachine combustors and, more specifically, to an axial fuel stage (AFS) injector with fuel injection in same direction as high-pressure air flow, and a combustor and a gas turbine system including the same.

BACKGROUND

Gas turbine systems include a combustion section including a plurality of combustors in which fuel is combusted to create a flow of combustion gas that is converted to kinetic energy in a downstream turbine section. Current combustors include a head end fuel nozzle assembly for combusting fuel in a primary combustion zone and axial fuel stage (AFS) injectors for combusting fuel in a secondary combustion zone downstream of the primary combustion zone. Portions of an air supply, for example, from a compressor discharge casing, are delivered to the head end fuel nozzle assembly and the AFS injectors in various flow passages. Current AFS injectors present challenges relative to adequately mixing highly reactive fuels, like hydrogen, with air and to achieving desired low exhaust emissions and desired flame holding capability.

BRIEF DESCRIPTION

All aspects, examples and features mentioned below can be combined in any technically possible way.

An aspect of the disclosure includes an axial fuel stage (AFS) injector for a combustor of a gas turbine (GT) system, the AFS injector comprising: a mixing member including a mixing chamber defined therein, the mixing chamber having an inlet and an outlet, wherein the outlet is configured to be in fluid communication with a combustion chamber of the combustor; and a high pressure (HP) air-fuel injection member including at least one row of HP air-fuel injectors for directing an air-fuel mixture into the mixing chamber, each HP air-fuel injector including: two opposing sidewalls and a middle wall extending longitudinally between the two opposing sidewalls, the middle wall and each opposing sidewall defining an elongated high pressure (HP) air jet therebetween; at least one fuel injector defined in a radially inner end of the middle wall; and a fuel plenum defined in the middle wall, the fuel plenum configured to deliver fuel from a fuel source to each of the at least one fuel injector, wherein each elongated HP air jet is configured to direct an HP air flow toward the inlet of the mixing chamber from an HP air source in a same direction as a fuel flow from the at least one fuel injector.

Another aspect of the disclosure includes any of the preceding aspects, and the at least one row of HP air-fuel injectors includes a first row of HP air-fuel injectors and a second row of HP air-fuel injectors, and the HP air-fuel injection member further includes a tapered diversion wall downstream and between an outlet of adjacent HP air jets of the first row of HP air-fuel injectors and the second row of HP air-fuel injectors.

Another aspect of the disclosure includes any of the preceding aspects, and the at least one row of HP air-fuel injectors includes a first row of HP air-fuel injectors, a second row of HP air-fuel injectors and a third row of HP air-fuel injectors between the first row and second row of HP air-fuel injectors.

Another aspect of the disclosure includes any of the preceding aspects, and the HP air-fuel injectors of the third row of HP air-fuel injectors direct the air-fuel mixture in a direction parallel to the mixing chamber, and the HP air-fuel injectors of the first row and the second row direct the air-fuel mixture at an acute angle to the direction parallel to the mixing chamber.

Another aspect of the disclosure includes any of the preceding aspects, and the HP air jets of the third row of HP air-fuel injectors are longer in a transverse direction, relative to an axial direction of the AFS injector, than the HP air jets of the first row and the second row of HP air-fuel injectors.

Another aspect of the disclosure includes any of the preceding aspects, and the HP air jets of the first, second and third rows of HP air-fuel injectors have a same length in a transverse direction, relative to an axial direction of the AFS injector.

Another aspect of the disclosure includes any of the preceding aspects, and the third row of HP air-fuel injectors is axially offset from the first row of HP air-fuel injectors and the second row of HP air-fuel injectors, and the HP air-fuel injection member further includes a tapered diversion wall downstream and between an outlet of adjacent HP air jets of the first row of HP air-fuel injectors and the second row of HP air-fuel injectors.

Another aspect of the disclosure includes any of the preceding aspects, and further comprising a recess defined in a radially inner wall of the HP air-fuel injection member between a plurality of adjacent HP air-fuel injectors of at least one of the first row of the first row of HP air-fuel injectors and the second row of HP air-fuel injectors.

Another aspect of the disclosure includes any of the preceding aspects, and the HP air-fuel injection member further includes at least one row of HP air jet slots circumferentially spaced from the at least one row of HP air-fuel injectors for directing another HP air flow toward the inlet of the mixing chamber from the HP air source.

Another aspect of the disclosure includes any of the preceding aspects, and the HP air-fuel injection member includes a diverging opening downstream of each HP air-fuel injector.

Another aspect of the disclosure includes any of the preceding aspects, and the two opposing sidewalls and the middle wall are connected at longitudinal ends thereof, wherein the two opposing sidewalls collectively have an elliptical cross-sectional shape.

Another aspect of the disclosure includes any of the preceding aspects, and the middle wall has a tear drop cross-sectional shape having a bulbous end and a tip end, and the at least one fuel injector is in the tip end.

Another aspect of the disclosure includes any of the preceding aspects, and wherein the at least one fuel injector includes a plurality of fuel injectors.

Another aspect of the disclosure includes any of the preceding aspects, and the fuel plenum defined in the middle wall extends from one end of the middle wall to an opposing end of the middle wall.

Another aspect of the disclosure includes any of the preceding aspects, and the HP air flow also draws a low pressure (LP) air from a LP air source to direct the LP air with the HP air into the inlet of the mixing chamber.

Another aspect of the disclosure includes any of the preceding aspects, and the HP air source is in direct fluid communication with a compressor discharge of the GT system, and the LP air source is in fluid communication with a cooling passage defined along at least a portion of a combustion liner of the combustor.

Another aspect of the disclosure includes any of the preceding aspects, and the mixing member and the HP air-fuel injection member each include at least one mounting element configured to receive a fastener to couple the mixing member and the HP air-fuel injection member to a combustion liner that defines the combustion chamber.

Another aspect of the disclosure includes a combustor for a gas turbine system, the combustor comprising: a combustor body including a combustion liner; and a plurality of axial fuel stage (AFS) injectors directed into the combustion liner, each AFS injector including: a mixing member including a mixing chamber defined therein, the mixing chamber having an inlet and an outlet, wherein the outlet is configured to be in fluid communication with a combustion chamber of the combustor; and a high pressure (HP) air-fuel injection member including at least one row of HP air-fuel injectors for directing an air-fuel mixture into the mixing chamber, each HP air-fuel injector including: two opposing sidewalls and a middle wall extending longitudinally between the two opposing sidewalls, the middle wall and each opposing sidewall defining an elongated high pressure (HP) air jet therebetween; at least one fuel injector defined in a radially inner end of the middle wall; and a fuel plenum defined in the middle wall, the fuel plenum configured to deliver fuel from a fuel source to each of the at least one fuel injector, wherein each elongated HP air jet is configured to direct an HP air flow toward the inlet of the mixing chamber from an HP air source in a same direction as a fuel flow from the at least one fuel injector.

Another aspect of the disclosure includes any of the preceding aspects, and the at least one row of HP air-fuel injectors includes a first row of HP air-fuel injectors, a second row of HP air-fuel injectors and a third row of HP air-fuel injectors between the first row and second row of HP air-fuel injectors.

Another aspect of the disclosure includes a gas turbine (GT) system, comprising: a compressor section; a combustion section operatively coupled to the compressor section; and a turbine section operatively coupled to the combustion section, wherein the combustion section includes at least one combustor including: a combustor body including a combustion liner; a head end fuel nozzle assembly at a forward end of the combustor body; and a plurality of axial fuel stage (AFS) injectors directed into the combustor body downstream of the head end fuel nozzle assembly, each AFS injector including: a mixing member including a mixing chamber defined therein, the mixing chamber having an inlet and an outlet, wherein the outlet is configured to be in fluid communication with a combustion chamber of the combustor; and a high pressure (HP) air-fuel injection member including at least one row of HP air-fuel injectors for directing an air-fuel mixture into the mixing chamber, each HP air-fuel injector including: two opposing sidewalls and a middle wall extending longitudinally between the two opposing sidewalls, the middle wall and each opposing sidewall defining an elongated high pressure (HP) air jet therebetween; at least one fuel injector defined in a radially inner end of the middle wall; and a fuel plenum defined in the middle wall, the fuel plenum configured to deliver fuel from a fuel source to each of the at least one fuel injector, wherein each elongated HP air jet is configured to direct an HP air flow toward the inlet of the mixing chamber from an HP air source in a same direction as a fuel flow from the at least one fuel injector.

Two or more aspects described in this disclosure, including those described in this summary section, may be combined to form implementations not specifically described herein. That is, all embodiments described herein can be combined with each other.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
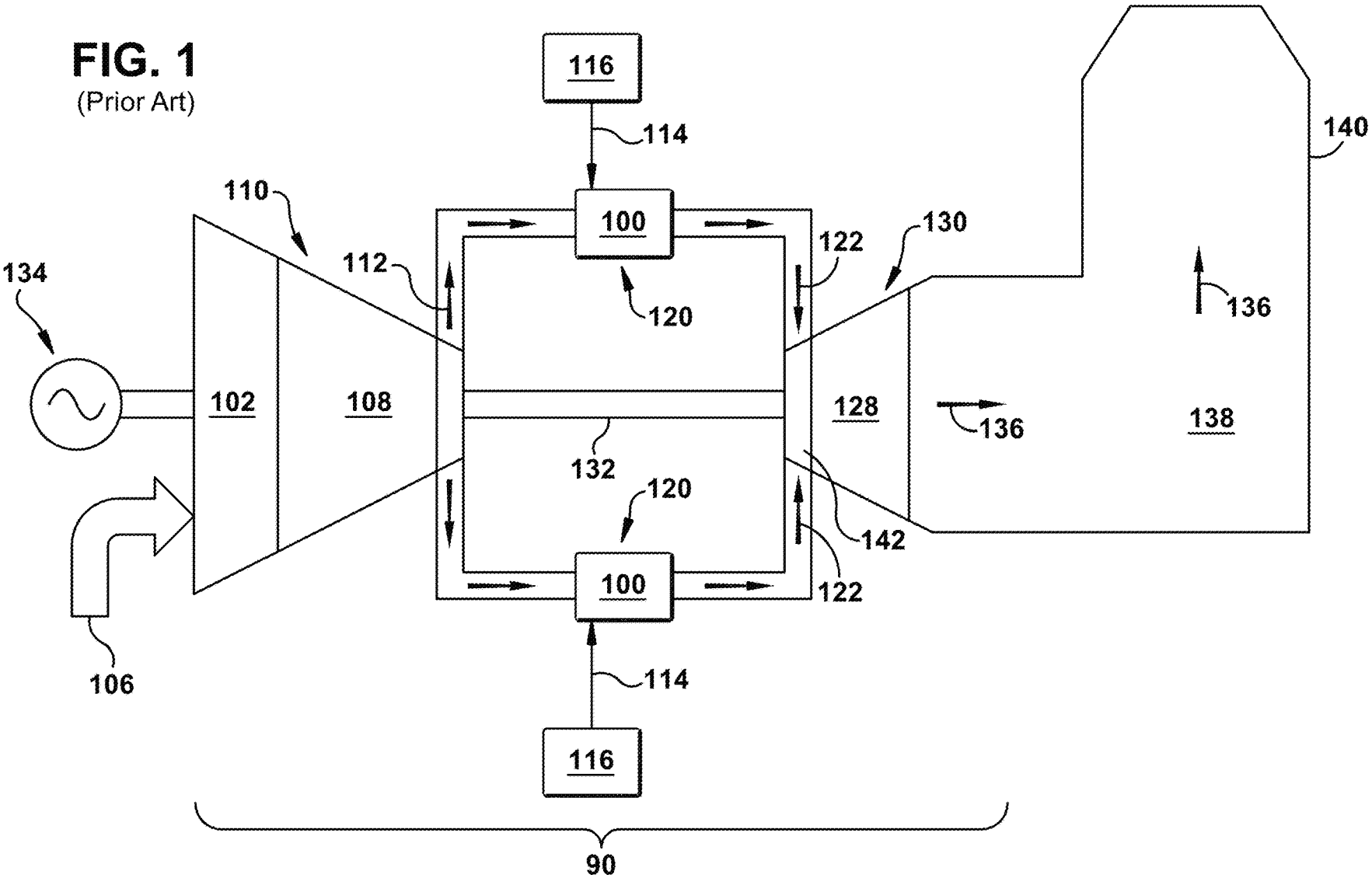
FIG. 1 (Prior Art)
FIG. 1 shows a functional block diagram of an illustrative gas turbine system capable of use with a combustor including an axial fuel stage (AFS) injector according to embodiments of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the current technology, it will become necessary to select certain terminology when referring to and describing relevant machine components within the illustrative application of a turbomachine combustor and axial fuel stage (AFS) injector. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through a combustor of the turbomachine or, for example, the flow of air through the combustor or AFS injector, or coolant through one of the turbomachine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the turbomachine or combustor, and "aft" referring to the rearward or turbine end of the turbomachine or combustor.

The term "axial" refers to movement or position parallel to an axis, e.g., an axis of a combustor, a mixing chamber of the AFS injector, or turbomachine. The term "radial" refers to movement or position perpendicular to an axis, e.g., an axis of a combustor or a turbomachine. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. Finally, the term "circumferential" refers to movement or position around an axis, e.g., a circumferential interior surface of a combustor body or a circumferential interior of casing extending about a combustor. As indicated above and depending on context, it will be appreciated that such terms may be applied in relation to the axis of the combustor or the axis of the turbomachine.

In addition, several descriptive terms may be used regularly herein, as described below. The terms "first," "second," and "third," may be used interchangeably to distinguish one component from another and are not intended to signify location or importance of the individual components.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event may or may not occur or that the subsequently described feature may or may not be present and that the description includes instances where the event occurs, or the feature is present and instances where the event does not occur, or the feature is not present.

Where an element or layer is referred to as being "on," "engaged to," "connected to," "coupled to," or "mounted to" another element or layer, it may be directly on, engaged, connected, coupled, or mounted to the other element or layer, or intervening elements or layers may be present. In contrast, when an element is referred to as being "directly on," "directly engaged to," "directly connected to," or "directly coupled to" another element or layer, there are no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The verb forms of "couple" and "mount" may be used interchangeably herein.

Embodiments of the disclosure provide an axial fuel stage (AFS) injector for a combustor, the combustor and a gas turbine (GT) system including the same. The AFS injector includes a mixing member having a mixing chamber defined therein. The mixing chamber includes an inlet and an outlet, and the outlet is configured to be in fluid communication with a combustion chamber of the combustor. A high pressure (HP) air-fuel injection member includes at least one row of HP air-fuel injectors for directing an air-fuel mixture into the mixing chamber. Each HP air-fuel injector includes two opposing sidewalls and a middle wall extending longitudinally between the two opposing sidewalls, the middle wall and each opposing sidewall defining an elongated high pressure (HP) air jet therebetween; at least one fuel injector defined in a radially inner end of the middle wall; and a fuel plenum defined in the middle wall, the fuel plenum configured to deliver fuel from a fuel source to each of the at least one fuel injector. Each elongated HP air jet is configured to direct a HP air flow toward the inlet of the mixing chamber from a HP air source in a same direction as a fuel flow from the at least one fuel injector. The mixing chamber directs the air-fuel mixture into the combustion liner for combustion in a secondary combustion zone thereof.

The AFS injector may optionally mix two sources of air, one being high-pressure air, e.g., from a compressor discharge, and the other a low-pressure air, e.g., post-impingement cooling air, to reduce overall system pressure loss and more efficiently use air in the combustor. In any event, the AFS injector can rapidly premix the air source(s) with, for example, highly reactive fuels, like hydrogen, to achieve low emissions, e.g., of nitrous oxide (NOx), and an acceptable flame holding capability. The AFS injector also achieves high mixedness of fuel and air, minimizes flow-pressure loss, and prevents fuel from entering any low velocity air flow zones. Additionally, the AFS injector is packaged in a relatively small geometry, allowing it to be assembled onto the combustion liner of a combustor body, and the combustor body installed into the GT system through the relatively small opening in a compressor discharge casing. The AFS injector may be additively manufactured to include a plurality of parallel, sintered metal layers.

FIG. 1 shows a functional block diagram of an illustrative gas turbine (GT) system 90 that may incorporate various embodiments of a combustor 100 and axial fuel stage (AFS) injectors 150 (FIG. 2) of the present disclosure. As shown, GT system 90 generally includes an inlet section 102 that may include a series of filters, cooling coils, moisture separators, and/or other devices to purify and otherwise condition a working fluid (e.g., air) 104 entering GT system 90. Working fluid 106, i.e., air, flows to a compressor 108 in a compressor section 110 that progressively imparts kinetic energy to working fluid 106 to produce a compressed, high-pressure (HP) air 112 (hereafter "HP air 112" or "compressed air 112") at a highly energized state. HP air 112 is typically mixed with a fuel 114A and/or 114B from a fuel source 116 to form a combustible mixture within at least one combustor 100 in a combustion section 120 that is operatively coupled to compressor section 110. The combustible mixture is burned to produce combustion gases 122 having a high temperature and pressure.

Combustion gases 122 flow through a turbine 128 of a turbine section 130 operatively coupled to combustion section 120 to produce work. For example, turbine 128 may be connected to a shaft 132 so that rotation of turbine 128 drives compressor 108 to produce HP air 112. Alternately, or in addition, shaft 132 may connect turbine 128 to another load, such as a generator 134 for producing electricity. Exhaust gases 136 from turbine 128 flow through an exhaust section 138 that connects turbine 128 to an exhaust stack 140 downstream from turbine 128. Exhaust section 138 may include, for example, a heat recovery steam generator (not shown) for cleaning and extracting additional heat from exhaust gases 136 prior to release to the environment. Where more than one combustor 100 is used, they may be circumferentially spaced around a turbine inlet 142 of turbine 128.

In one embodiment, GT system 90 may include an engine model commercially available from GE Vernova of Cambridge, MA. The present disclosure is not limited to any one particular GT system and may be implemented in connection with other engines including, for example, any HA, F, B, LM, GT, TM and E-class engine models of GE Vernova, and engine models of other companies. Furthermore, the present disclosure is not limited to implementation within any particular turbomachine, and may be applicable to, for example, steam turbines, jet engines, compressors, turbofans, etc.

Figure 2:
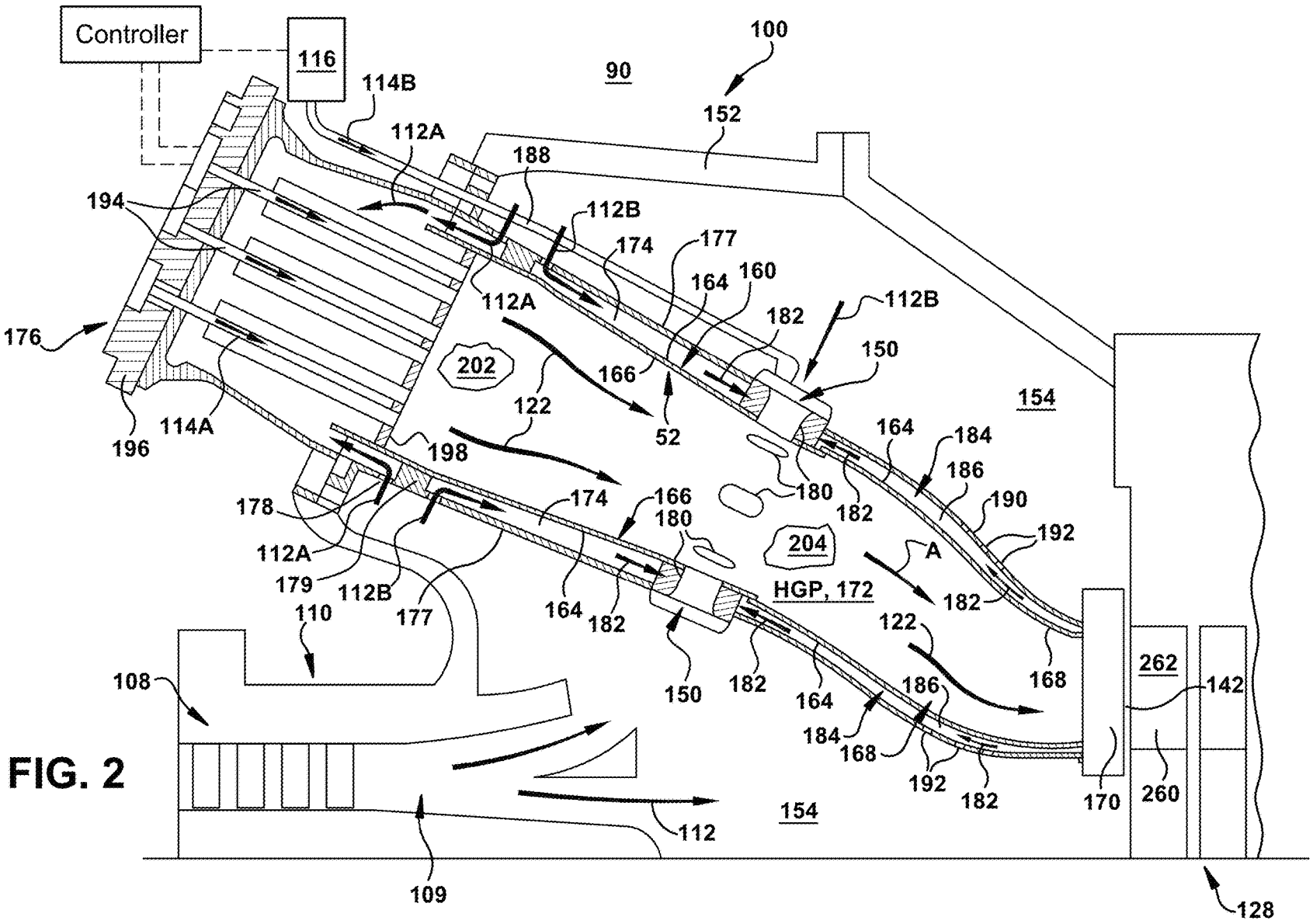
FIG. 2 shows a cross-sectional side view of a combustor including an AFS injector according to embodiments of the disclosure.

A combustor 100 usable within GT system 90 will now be described. FIG. 2 shows a cross-sectional side view of combustor 100 positioned within GT system 90. As will be further described herein, combustor 100 may include one or more axial fuel stage (AFS) injectors 150 according to embodiments of the disclosure.

As shown in FIG. 2, combustor 100 is at least partially surrounded by an outer casing 152 such as a compressor discharge casing and/or a turbine casing. An interior of outer casing 152 is in fluid communication with a compressor discharge 109 of compressor 108 and creates an HP air source 154. That is, HP air source 154 includes HP air 112 from compressor discharge of compressor 108. HP source 154 is in direct fluid communication with compressor discharge 109 of GT system 90. However, HP air source 154 may be any supply of HP air 112 capable of flowing into any variety of openings or flow passages in combustor 100 to cool parts and/or for combustion, i.e., in AFS injectors 150.

As shown in FIG. 2, combustor 100 for GT system 90 includes a combustor body 160. Combustor body 160 may be made using any now known or later developed techniques. For example, combustor body 160 may be additively manufactured. Combustor body 160 may include a combustion liner 164, which may include, for example, a cylindrical portion 166 and a tapered transition portion 168. Combustion liner 164 may have an axis A, the direction of which may vary slightly depending on axial location within the curved combustion liner 164. Tapered transition portion 168 is at an aft end (right side as shown in FIG. 2) of cylindrical portion 166. As understood in the field, tapered transition portion 168 transitions the hot gas path (HGP) from the circular cross-section of the liner's cylindrical portion 166 to a more arcuate cross-section for mating with turbine inlet 142 of turbine 128. Combustor 100 may also include an aft frame 170 at an aft end (right side in FIG. 2) of tapered transition portion 168.

Combustion liner 164 may contain and convey combustion gases 122 to turbine section 130 (FIG. 1). More particularly, combustion liner 164 defines a combustion chamber 172, i.e., in a hot gas path (HGP), within which combustion occurs. Combustion liner 164 may have tapered transition portion 168 that is separate from cylindrical portion 166, as in many conventional combustion systems. Alternatively, as shown in FIG. 2, combustion liner 164 may have a unified body (or "unibody") construction, in which cylindrical portion 166 and tapered transition portion 168 are integrated with one another, i.e., as part of an additively manufactured one-piece member. Thus, any discussion of combustion liner 164 herein is intended to encompass both conventional combustion systems having a separate cylindrical and tapered transition portions and those combustion systems having a unibody liner.

Combustor body 160 also includes an air flow passage 174 defined at least partially by cylindrical portion 166 of combustion liner 164. As will be described herein, air flow passage 174 is configured to deliver air (e.g., HP air 112A from HP air source 154) to a head end fuel nozzle assembly 176 (hereinafter "head end assembly 176" for brevity) of combustor 100 at a forward end (left end in FIG. 2) of combustion liner 164. That is, it is sized, shaped and/or arranged to deliver air, such as HP air 112A from HP air source 154, to head end assembly 176 of combustor 100. Air flow passage 174 may be defined wholly within cylindrical portion 166, or air flow passage 174 may be provided between cylindrical portion 166 and a flow sleeve 177 spaced along at least a portion of an exterior surface of cylindrical portion 166. Air flow passage 174 has an open end 178, or air flow opening(s), proximate to head end assembly 176 through which HP air 112A from HP air source 154 enters. Here, HP air 112A from HP air source 154 may be pulled directly from compressor discharge, i.e., without any other use of the air other than coincidental convection cooling of combustor body 160.

An annular partition 179 disposed between cylindrical portion 166 and flow sleeve 177 separates a forward portion of air flow passage 174 from an aft portion of air flow passage 174. The axial position of annular partition 179 is approximately aligned with a cap assembly 198, discussed below, such that the forward portion of air flow passage 174 is radially outward of head end assembly 176 (rather than combustion chamber 172) and, therefore, requires less cooling. Aftward of annular partition 179, flow sleeve 177 may include a plurality of impingement holes 192 (as shown in outer sleeve 190), which permit HP air 112B to flow into air flow passage 174. As a result of passing through impingement holes 192, HP air 112B experiences a pressure drop and becomes LP air 182, which flows through air flow passage 174 toward and/or into AFS injector(s) 150, as discussed further herein.

Head end assembly 176 generally includes at least one axially extending fuel nozzle 194 that extends downstream from an end cover 196 and a cap assembly 198, which extends radially and axially within outer casing 152 downstream from end cover 196 and which defines the forward boundary of combustion chamber 172. Head end assembly 176 may include any now known or later developed axially extending fuel nozzles 194 for delivering first fuel 114A to a primary combustion zone 202 from axially extending fuel nozzles 194. In certain embodiments, axially extending fuel nozzle(s) 194 of head end assembly 176 extend at least partially through cap assembly 198 to provide a combustible mixture of fuel 114A and HP air 112A to primary combustion zone 202.

Combustor body 160 also includes an axial fuel stage (AFS) injector opening or seat 180 directed into combustion liner 164 downstream of head end assembly 176. Opening or seat 180 extends through a wall of combustion liner 164. One or more AFS injector openings or seats 180 (hereafter "openings 180") can be provided and are configured to have an AFS injector 150 mounted thereto and receive HP air 112B from HP air source 154, among possible other air flow(s) as will be described herein. Each AFS injector opening 180 may include any necessary structure to allow an AFS injector 150 to be mounted thereto, e.g., threaded fasteners, bolt holes, weld area, etc. As illustrated, combustor 100 and combustor body 160 may include a plurality of circumferentially spaced AFS injector openings 180 and corresponding AFS injectors 150. Any number of AFS injectors 150 can be used.

As will be described, in some embodiments, AFS injector (s) 150 may also be configured to receive (draw in) a low-pressure (LP) air 182 from a low-pressure (LP) air source 184, e.g., cooling passage, and direct it into combustion liner 164 with fuel 114B. Fuel 114B may be delivered from fuel source 116 using any form of fuel line(s) 188. Fuel 114A, 114B may be any now known or later developed combustor 100 fuels, such as but not limited to fuel oil, natural gas, hydrogen, and/or blends thereof. Fuels 114A, 114B may be the same or different.

In some embodiments, LP air 182 can be delivered to AFS injector(s) 150 in a variety of ways from LP air source 184. In certain embodiments, LP air 182 originates from HP air source 154 but is used for cooling prior to use in AFS injector(s) 150. In one example, combustor body 160 further includes a cooling passage(s) 186 at least partially defined by tapered transition portion 168. In this setting, cooling passage(s) 186 constitute LP air source 184. Cooling passage(s) 186 may also be in fluid communication with other cooling passages (not shown) in combustor 100, e.g., in an aft frame 170. In any event, LP air 182 of LP air source 184 may be used for cooling one or more hot parts of combustor 100. More particularly, LP air 182 of LP air source 184 passes through cooling passage(s) 186, which be at least partially defined by tapered transition portion 168, after being pulled from compressor discharge 109.

In one example, cooling passage(s) 186 may be formed by a flow sleeve 190 or within tapered transition portion 168. Where desired, impingement cooling holes 192 may be provided in flow sleeve 190 surrounding tapered transition portion 168 to allow HP air 112 to enter from HP air source 154 and become LP air 182. In this regard, LP air source 184 includes cooling passage(s) 186 defined along at least a portion of combustion liner 164, e.g., tapered transition portion 168, and any upstream cooling passages in other hot parts of combustor 100. Further, cooling passage(s) 186 may be downstream of an impingement cooling member (portion 168 with impingement cooling holes 192 in outer sleeve thereof or sleeve 190 around portion 168 with holes 192 therein) which is in direct fluid communication with compressor discharge 109 of GT system 90, i.e., HP air source 154. It is noted that the hot part(s) may include any part of combustor 100 requiring cooling, and LP air 182 may be directed to enter cooling passage(s) 186 in any manner desired. That is, cooling passage(s) 186 may be defined in or along (other) hot part(s) of combustor 100 other than tapered transition portion 168, e.g., aft frame 170. LP air source 184 may also be considered to be in fluid communication with cooling passage 186 defined along at least a portion of combustion liner 164 of combustor 100. In any event, cooling passage(s) 186 is/are between AFS injector(s) 150 and HP air source 154 with the cooling passage(s) 186, in some embodiments, being configured to deliver LP air 182 of LP air source 184 to AFS injector(s) 150. LP air 182 from LP air source 184 may also be referred to herein as a "post-cooling" or "post-impingement air" since it is used to provide significant cooling of parts of combustor 100.

As noted, combustor 100 includes at least one axial fuel stage (AFS) injector 150 directed into combustor body 160, i.e., combustion liner 164. As noted, AFS injector(s) 150 may include a plurality of AFS injectors 150 circumferentially spaced around combustor body 160. Each AFS injector 150 extends radially toward an opening 180 in combustion liner 164 downstream from head end assembly 176, i.e., downstream from axially extending fuel nozzle(s) 194. As will be further described, AFS injectors 150 are configured to receive HP air 112B of HP air source 154 and second fuel 114B for combustion in a secondary combustion zone 204 that is downstream from primary combustion zone 202. In certain embodiments, AFS injectors 150 may optionally draw in LP air 182 from LP air source 184. In this latter case, LP air 182 of LP air source 184 may be routed to AFS injector(s) 150, e.g., in cooling passage(s) 186, to combine with HP air 112B and second fuel 114B for combustion in a secondary combustion zone 204 that is downstream from primary combustion zone 202.

Figure 3:
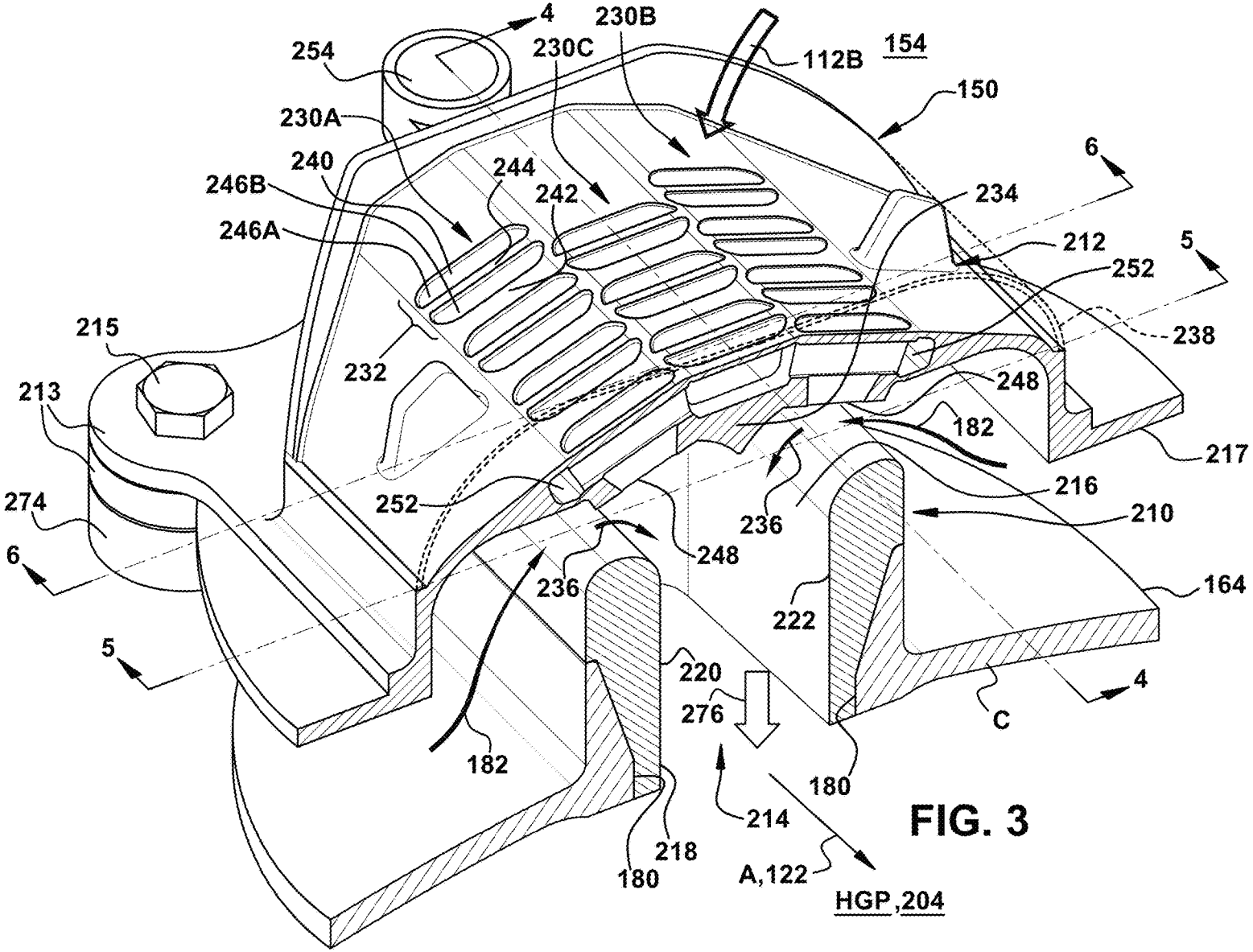
FIG. 3 shows a perspective and partial cross-sectional view of an AFS injector according to embodiments of the disclosure.
Figure 4:
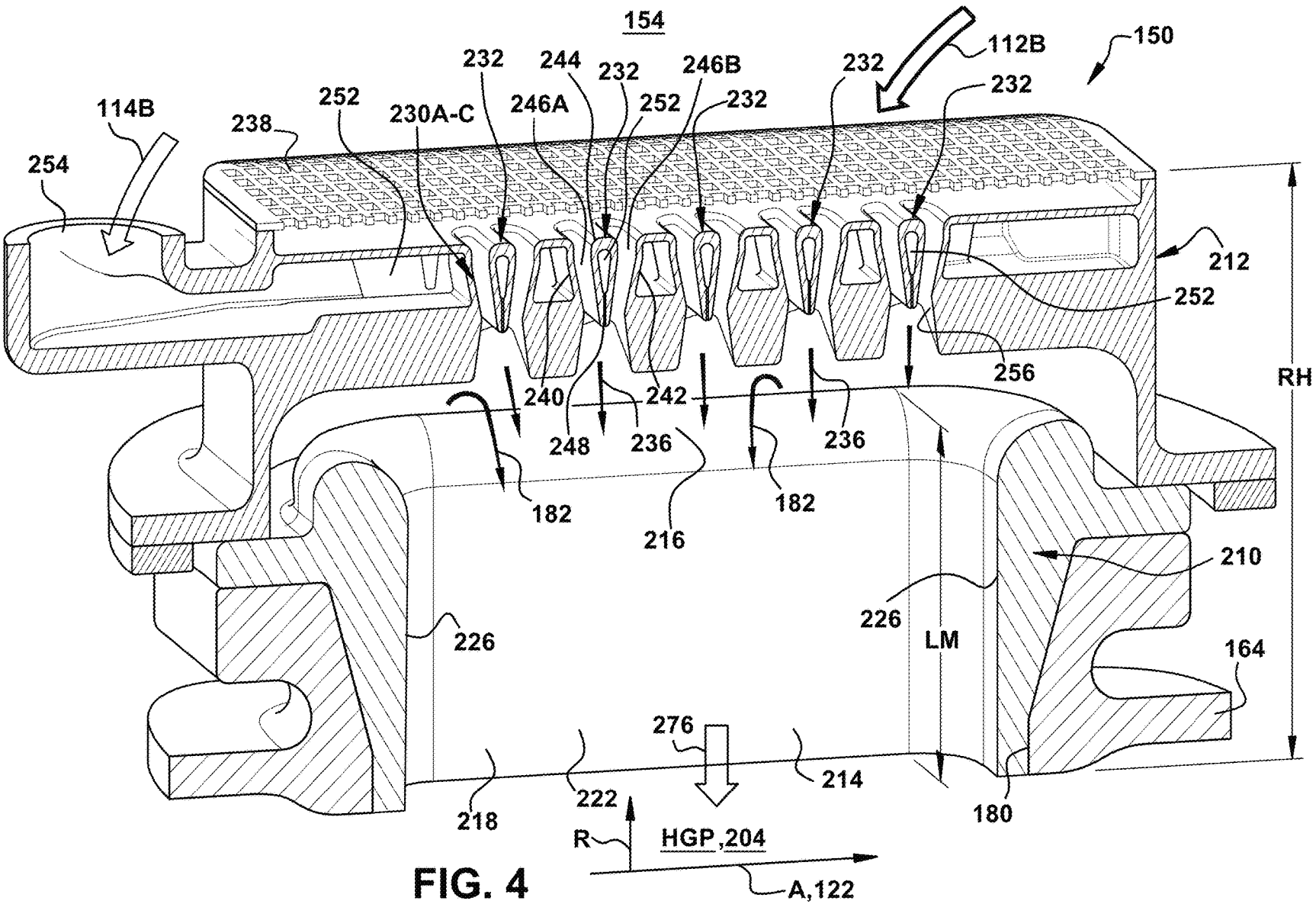
FIG. 4 shows a cross-sectional view of an AFS injector along view line 4-4 in FIG. 3 according to embodiments of the disclosure.
Figure 5:
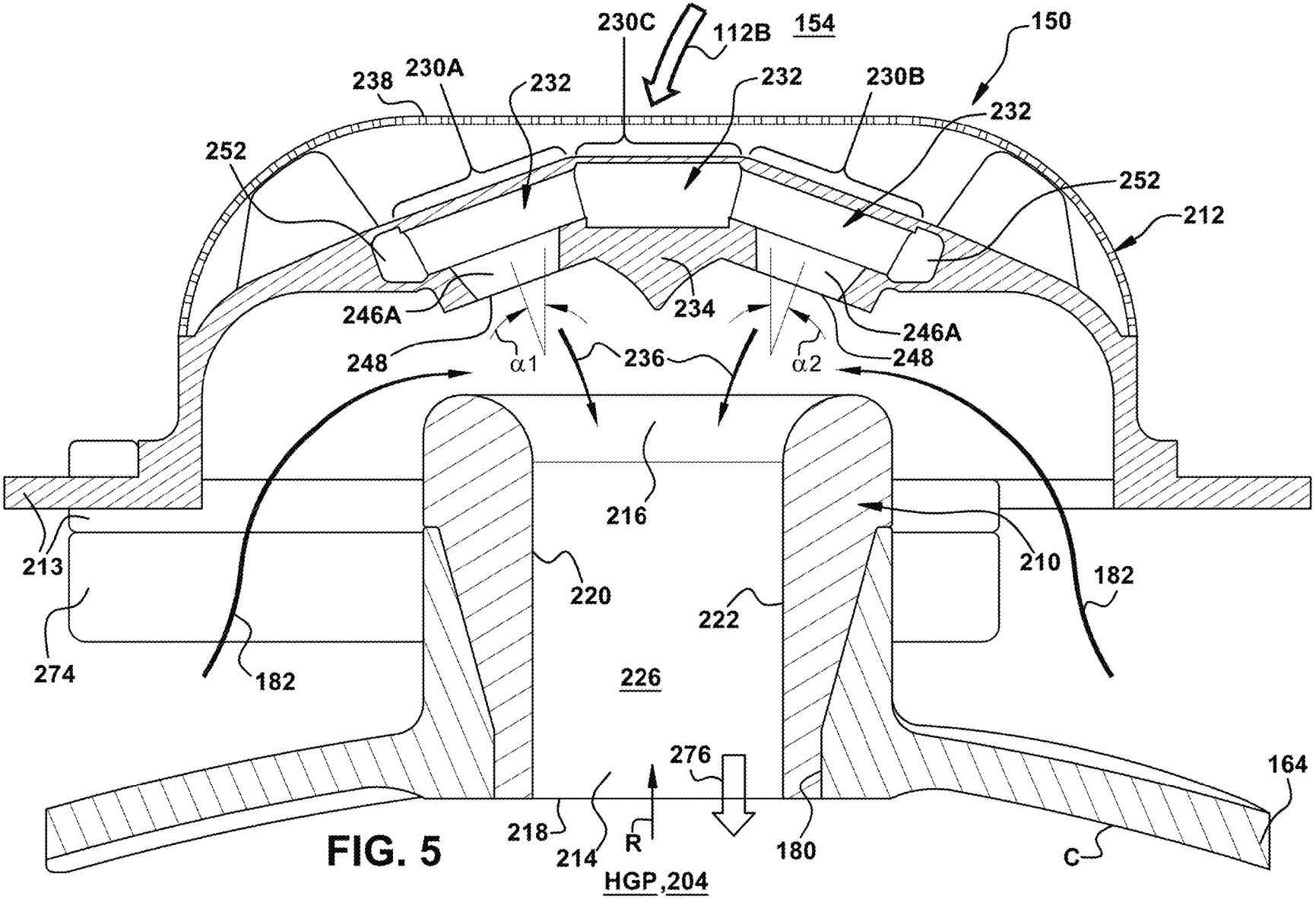
FIG. 5 shows a cross-sectional view of an AFS injector along view line 5-5 in FIG. 3 according to embodiments of the disclosure.
Figure 6:
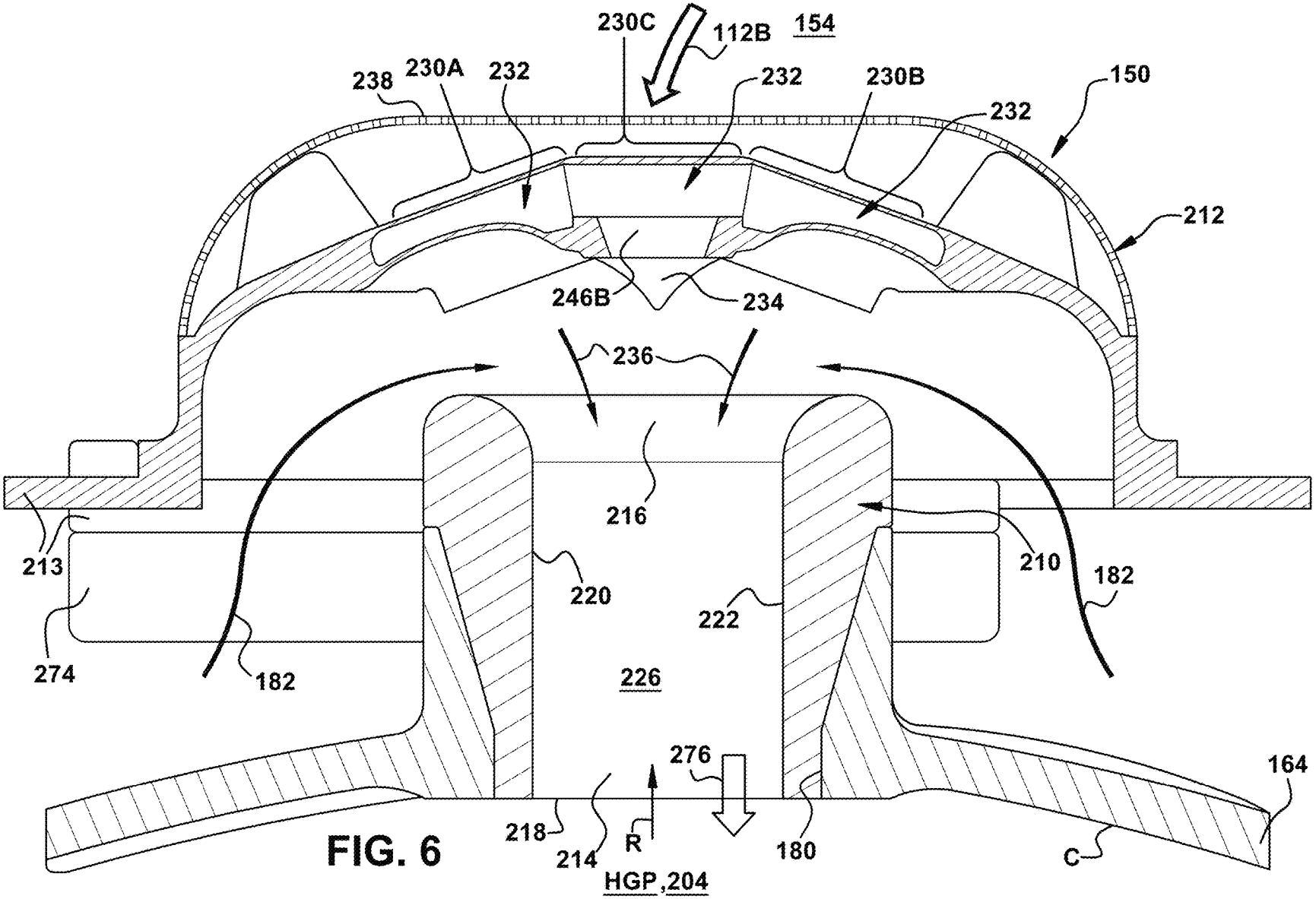
FIG. 6 shows a cross-sectional view of an AFS injector along view line 6-6 in FIG. 3 according to embodiments of the disclosure.

FIGS. 3-6 show various views of AFS injector 150 according to embodiments of the disclosure. FIG. 3 shows a perspective and partial cross-sectional view of AFS injector 150; FIG. 4 shows a cross-sectional view along view line 4-4 of FIG. 3; FIG. 5 shows a cross-sectional view along view line 5-5 in FIG. 3; and FIG. 6 shows a cross-sectional view along view line 6-6 in FIG. 3. AFS injector 150 includes a mixing member 210 and a high pressure (HP) air-fuel injection member 212. Mixing member 210 and HP air-fuel injection member 212 are coupled together to form AFS injector 150. More particularly, as shown in FIGS. 3-6, mixing member 210 and HP air-fuel injection member 212 may each include at least one mounting element 213 configured to receive a fastener 215 (e.g., bolt, weld or other fastener) to couple mixing member 210 and HP air-fuel injection member 212 to combustor body 160 (FIG. 2), e.g., to AFS injector mounts 274 coupled to outer sleeve 190. Alternatively, mixing member 210 and HP air-fuel injection member 212 may be formed as a single, integrated piece, e.g., by additive manufacturing. Each AFS injector 150 is aligned with, and installed within, a respective opening 180 in combustion liner 164. Hereafter, HP air-fuel injection member 212 is sometimes referred to as "injection member 212" for brevity.

As shown in FIG. 3-6, mixing member 210 includes a mixing chamber 214 defined therein. Mixing chamber 214 includes an inlet 216 and an outlet 218. Inlet 216 is radially inward of HP air-fuel injection member 212 and outlet 218 is configured to be in fluid communication with combustion liner 164 of combustor 100 (FIG. 2). Outlets 218 may be defined by mixing member 210 have any cross-sectional shapes. In one example, outlet 218 has an axially-elongated slot cross-sectional shape. In any event, mixing member 210 at outlet 218 may be positioned and fixed in opening 180 in combustion liner 164.

Mixing chamber 214 may take a variety of forms. More particularly, as shown in FIGS. 3-6, mixing chamber 214 may be axially elongated and have generally elongated chamber with elongated opposing walls 220, 222 and opposing ends 226. Mixing chamber 214 is referred to as "axially-elongated" because the longitudinal length thereof may be generally aligned with an axis A of combustion liner 164. As shown in FIG. 4, opposing ends 226 may be rounded as they transition to respective opposing walls 220, 222. That is, two opposing sidewalls 220, 222 and opposing ends 226 are connected at longitudinal ends thereof, thereby defining an elliptical cross-sectional shape. Although not shown, some curvature and/or narrowing from inlet 216 to outlet 218 may be provided in mixing chamber 214, where desired.

Referring to FIGS. 3, 5 and 6, mixing chamber 214 may extend radially relative to a circumference C of combustion liner 164 (right-to-left on page of FIGS. 5-6). Hence, mixing chamber 214 extends radially relative to axis A of combustion liner 164, i.e., along a particular radial direction R. Dimensions of mixing chamber 214 can be user defined based on among many other factors: characteristics of fuel 114B, HP air 112B, LP air 182, and/or combustion liner 164. As shown in FIG. 4, length LM of mixing chamber 214 from inlet 216 to outlet 218 can be user-defined. The dimensions of any part of mixing member 210 (and HP air-fuel injection member 212) of AFS injectors 150 may be customized to create a desired (final) air-fuel mixture 276 to be generated thereby.

Figure 7:
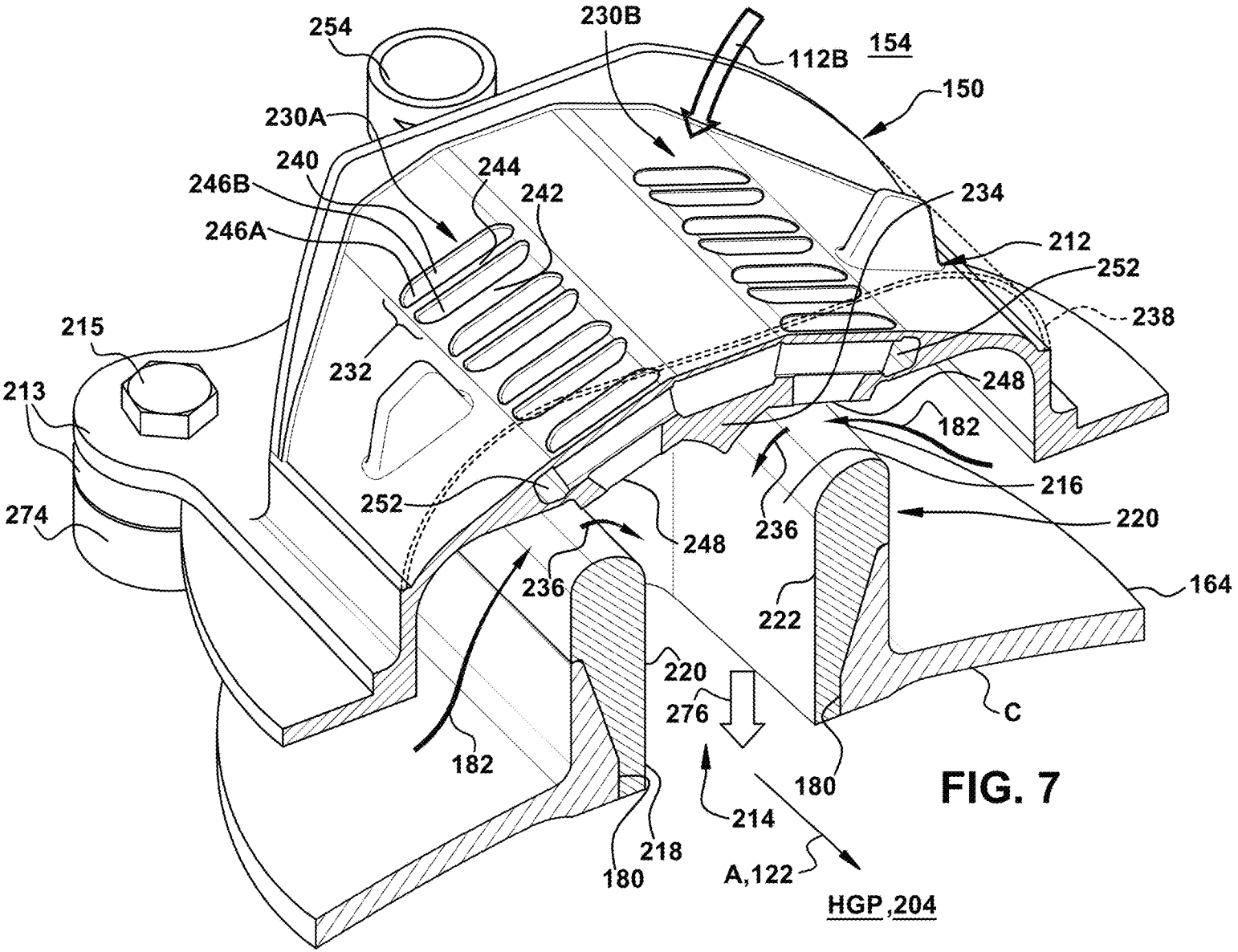
FIG. 7 shows a perspective and partial cross-sectional view of an AFS injector according to other embodiments of the disclosure.
Figure 8:
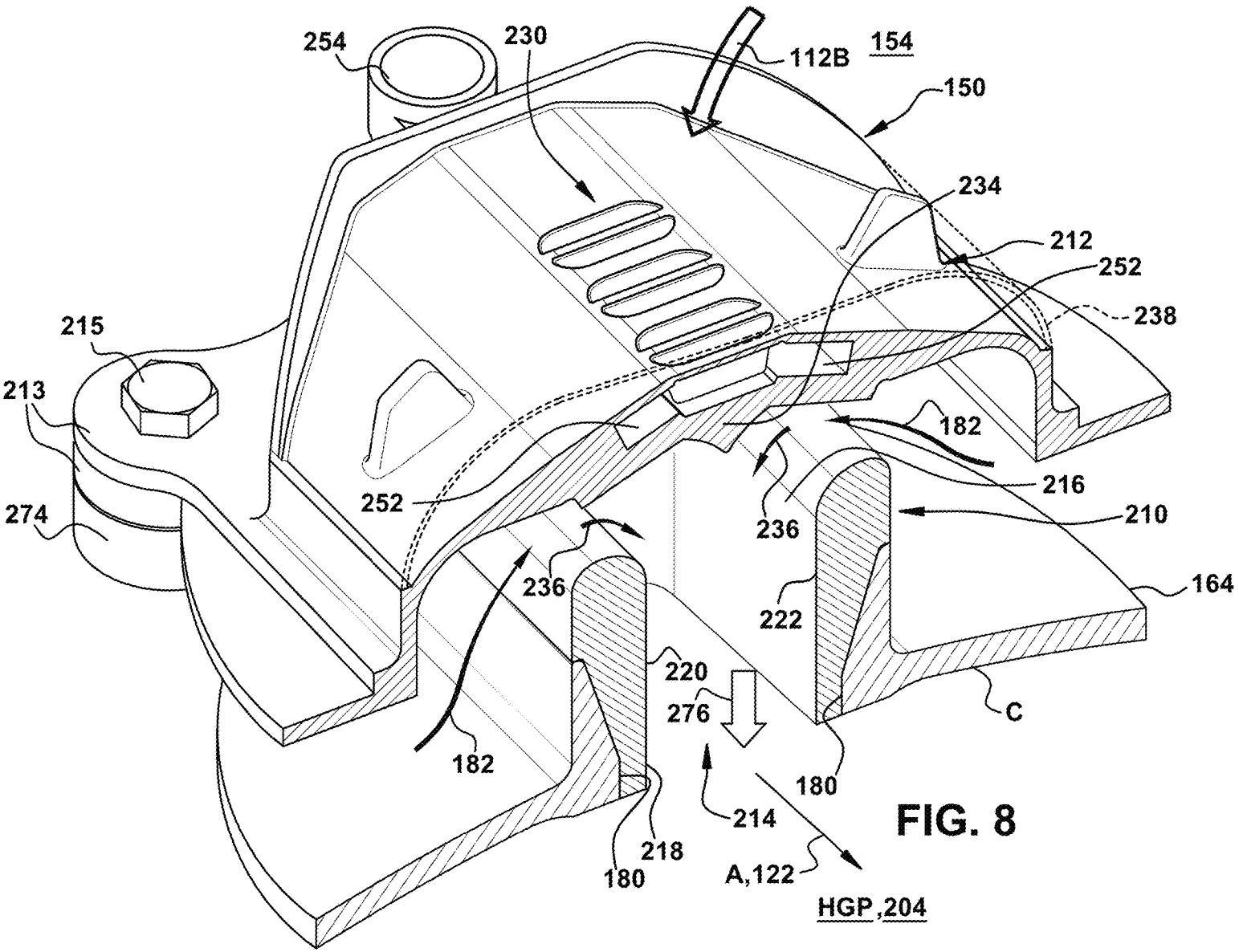
FIG. 8 shows a perspective and partial cross-sectional view of an AFS injector according to other embodiments of the disclosure.

With continuing reference to FIGS. 3-6, HP air-fuel injection member 212 will now be described. It is noted that HP air-fuel injection member 212 may also be referred to as a "top hat." HP air-fuel injection member 212 includes at least one row 230 of HP air-fuel injectors 232 for directing an (initial) air-fuel mixture 236 into mixing chamber 214. In FIGS. 3-6, three rows 230A-C of HP air-fuel injectors 232 are shown. More particularly, the at least one row 230 of HP air-fuel injectors 232 includes a first row 230A of HP air-fuel injectors 232, a second row 230B of HP air-fuel injectors 232 and a third row 230C of HP air-fuel injectors 232 between first row 230A and second row 230B of HP air-fuel injectors 232. FIG. 7 shows a perspective and partial cross-sectional view of an AFS injector with two rows 230A-B of HP air-fuel injectors 232. That is, the at least one row 230 of HP air-fuel injectors 232 includes a first row 230A of HP air-fuel injectors 232 and a second row 230B of HP air-fuel injectors 232. FIG. 8 shows a perspective and partial cross-sectional view of an AFS injector 150 with one row 230 of HP air-fuel injectors 232.

As shown in FIGS. 4-6, HP air-fuel injection member 212 may optionally include a filter member 238 upstream of the set of HP air-fuel injectors 232. Note, filter member 238 is not shown in FIG. 3 for clarity. Filter member 238 may include any now known or later developed filter structure capable of preventing unwanted contaminants from entering AFS injector 150 from HP air source 154.

Figure 10:
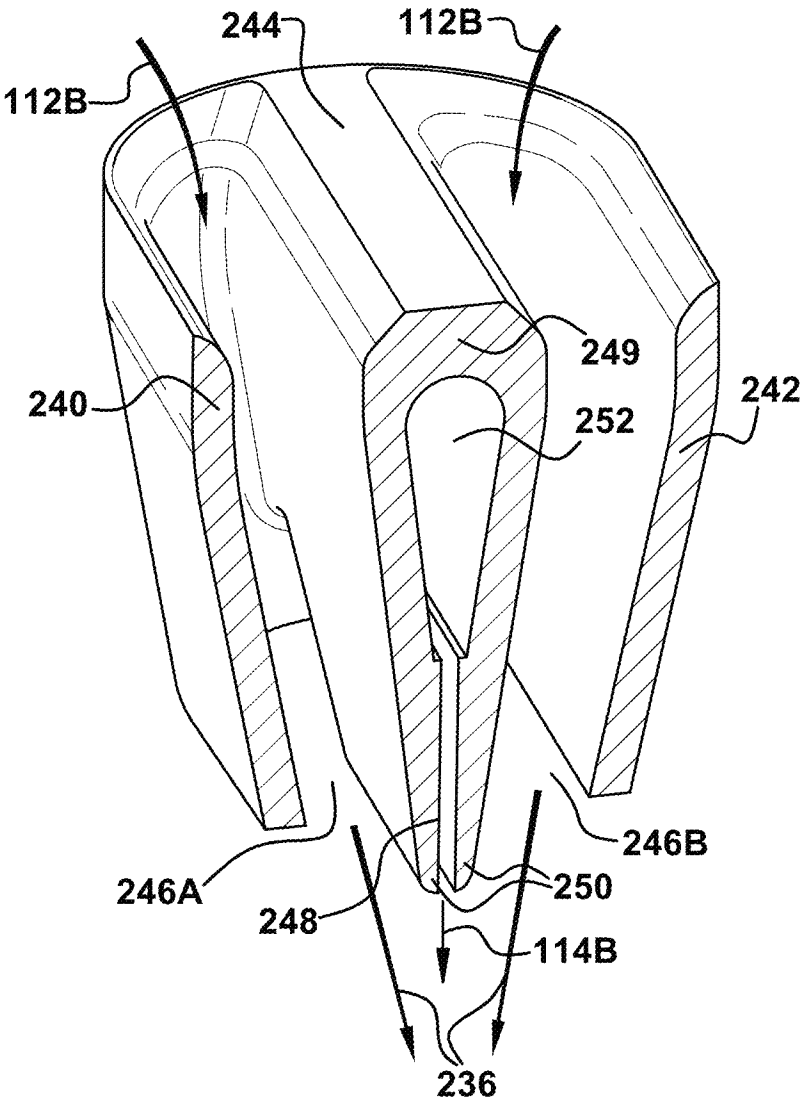
FIG. 10 shows a schematic cross-sectional view of a high-pressure air-fuel injector for an AFS injector according to embodiments of the disclosure.
Figure 9:
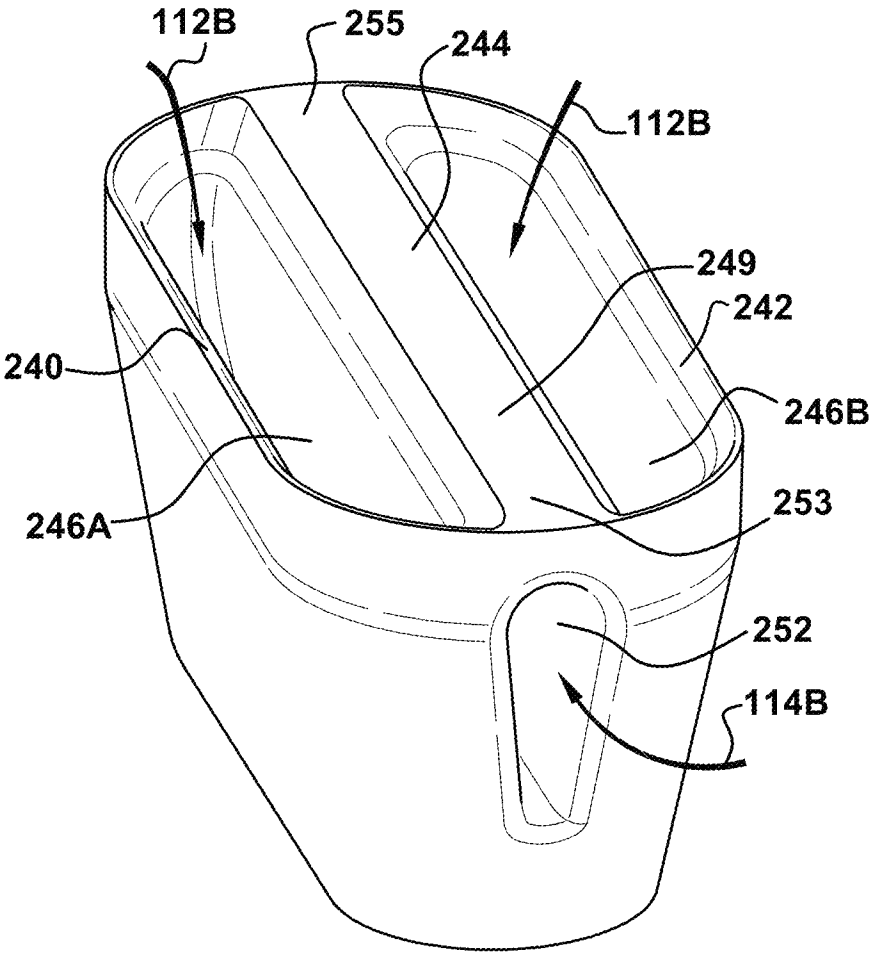
FIG. 9 shows a schematic perspective view of a high-pressure air-fuel injector for an AFS injector according to embodiments of the disclosure.

FIG. 9 shows a schematic perspective and FIG. 10 shows a schematic cross-sectional view of an HP air-fuel injector 232 according to embodiments of the disclosure. It is noted that the schematic view of HP air-fuel injector 232 in FIGS. 9 and 10 are referred to as schematic because the injectors typically are built with the rest of injection member 212, e.g., using additive manufacturing, and would not be separate entities as illustrated. Each HP air-fuel injector 232 includes two opposing sidewalls 240, 242 and a middle wall 244 extending longitudinally between two opposing sidewalls 240, 242. Middle wall 244 and each opposing sidewall 240, 242 define an elongated high pressure (HP) air jet 246A, 246B therebetween. HP air jets 246A, 246B may have any desired cross-sectional shape. In one non-limiting example, each HP air jet 246A, 246B has an elongated cross-sectional shape, e.g., slot with rounded ends, elliptical or oval. HP air jets 246A, 246B are longer than they are wide and typically are relatively thin openings. The axial spacing of HP air jets 246A, 246B (and HP air-fuel injectors 232) relative to axis A of combustion liner 164 can be user defined to generate the desired air-fuel mixture 236. In certain embodiments, as shown in FIG. 9, two opposing sidewalls 240, 242 and middle wall 244 may be connected at longitudinal ends thereof, and the two opposing sidewalls 240, 242 collectively have an elliptical cross-sectional shape, i.e., a racetrack shape. In other examples, not shown, each HP air jet 246A, 246B may have a circular cross-sectional shape. (Note, the details of only one HP air-fuel injector 232 is labeled in each of FIGS. 3-4 for clarity.)

Each HP air-fuel injector 232 also includes at least one fuel injector 248 defined in a radially inner (tip) end 250 (FIG. 10 only) of middle wall 244 and in fluid communication with a fuel plenum 252 defined in, among other areas, middle wall 244. Radially inner end 250 of middle wall 244 may also be a trailing end relative to HP air 112B flow in HP air-fuel injector 232. In some cases, middle wall 244 may have a tear drop cross-sectional shape (or symmetrical airfoil) having a bulbous end 249 and a narrow tip (radially inner) end 250, and at least one fuel injector 248 is in tip end 250. Middle wall 244 may also have other cross-sectional shapes. (Note, fuel plenum 252 is not shown in FIG. 6, and fuel injector(s) 248 are not shown in FIGS. 6 and 9.) As shown in FIG. 9, fuel plenum 252 defined in middle wall 244 may extend from one end 253 of middle wall 244 to an opposing end 255 of middle wall 244. However, in other cases, fuel plenum 252 may extend only partially lengthwise in middle wall 244, e.g., so middle wall 244 is open at one end and closed at the other. Otherwise, fuel plenum 252 is configured to deliver fuel 114B from fuel source 116 to each of fuel injector(s) 248.

Fuel plenum 252 may extend within HP air-fuel injection member 212 in any manner necessary to supply fuel 114B to the desired HP air-fuel injectors 232. More particularly, fuel plenum 252 may extend around each HP air-fuel injector 232 and into each injector's middle wall 244. AFS injector 150 and, more particularly, HP air-fuel injection member 212 may also include an inlet port 254 (FIGS. 3-4) in fluid communication with fuel plenum 252 and configured to receive fuel 114B from fuel source 116 (FIGS. 1-2). Inlet port 254 of each AFS injector 150 may be fluidly coupled to fuel source 116 by, for example, fuel line(s) 188 (FIG. 2) and optionally a distribution plenum (not shown) about combustion liner 164. In any event, fuel plenum 252 is configured to deliver fuel 114B from fuel source 116 to fuel injector(s) 248. As noted, fuel 114B may be any now known or later developed combustor 100 fuel such as but not limited to fuel oil, natural gas, etc. Due to the advantages of AFS injector 150, fuel 114B may also include highly reactive fuels such as hydrogen. Fuel 114B may also include blends of fuels such as natural gas and hydrogen.

Figure 11:
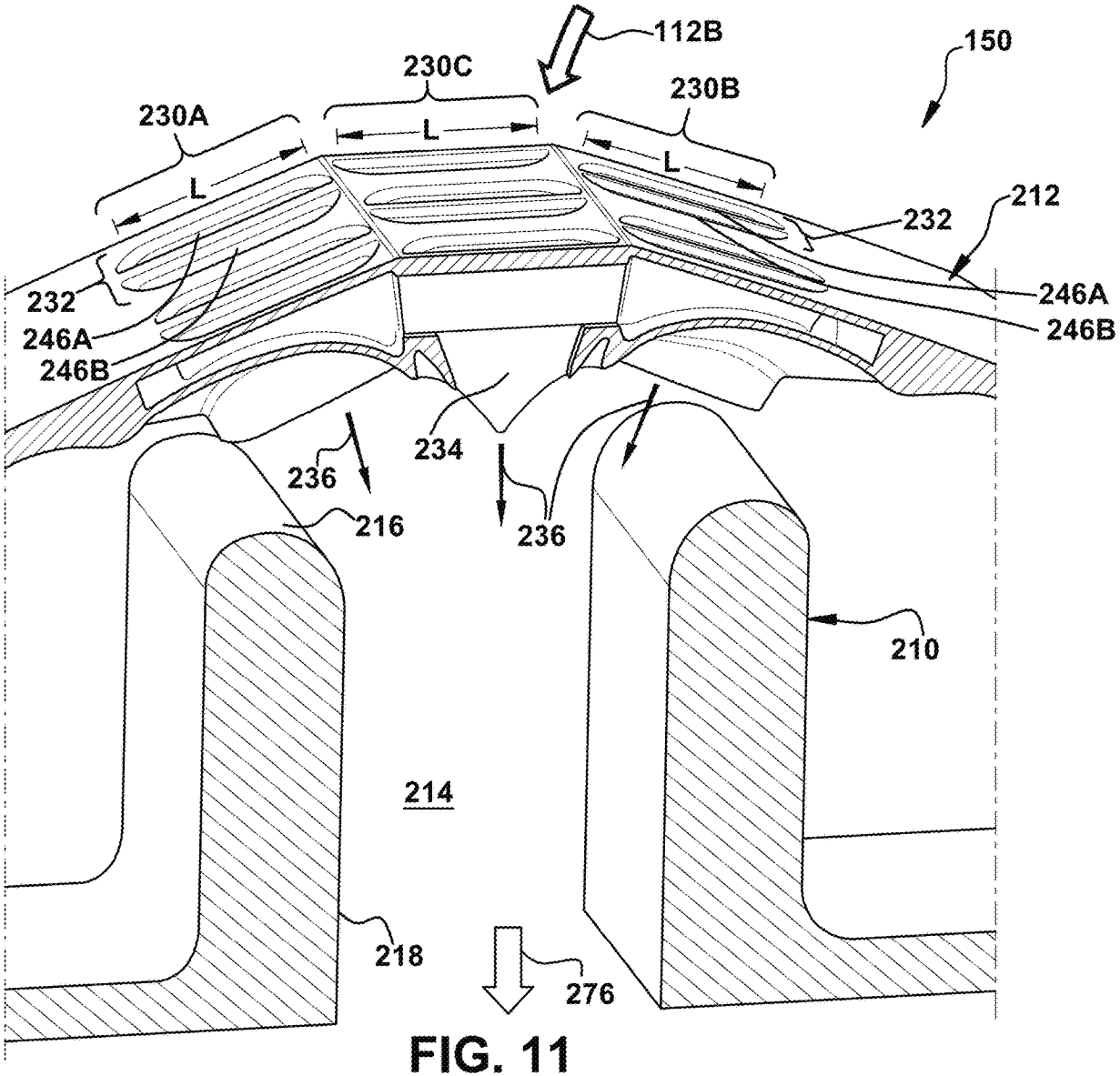
FIG. 11 shows an enlarged cross-sectional perspective view of an AFS injector according to embodiments of the disclosure.
Figure 12:
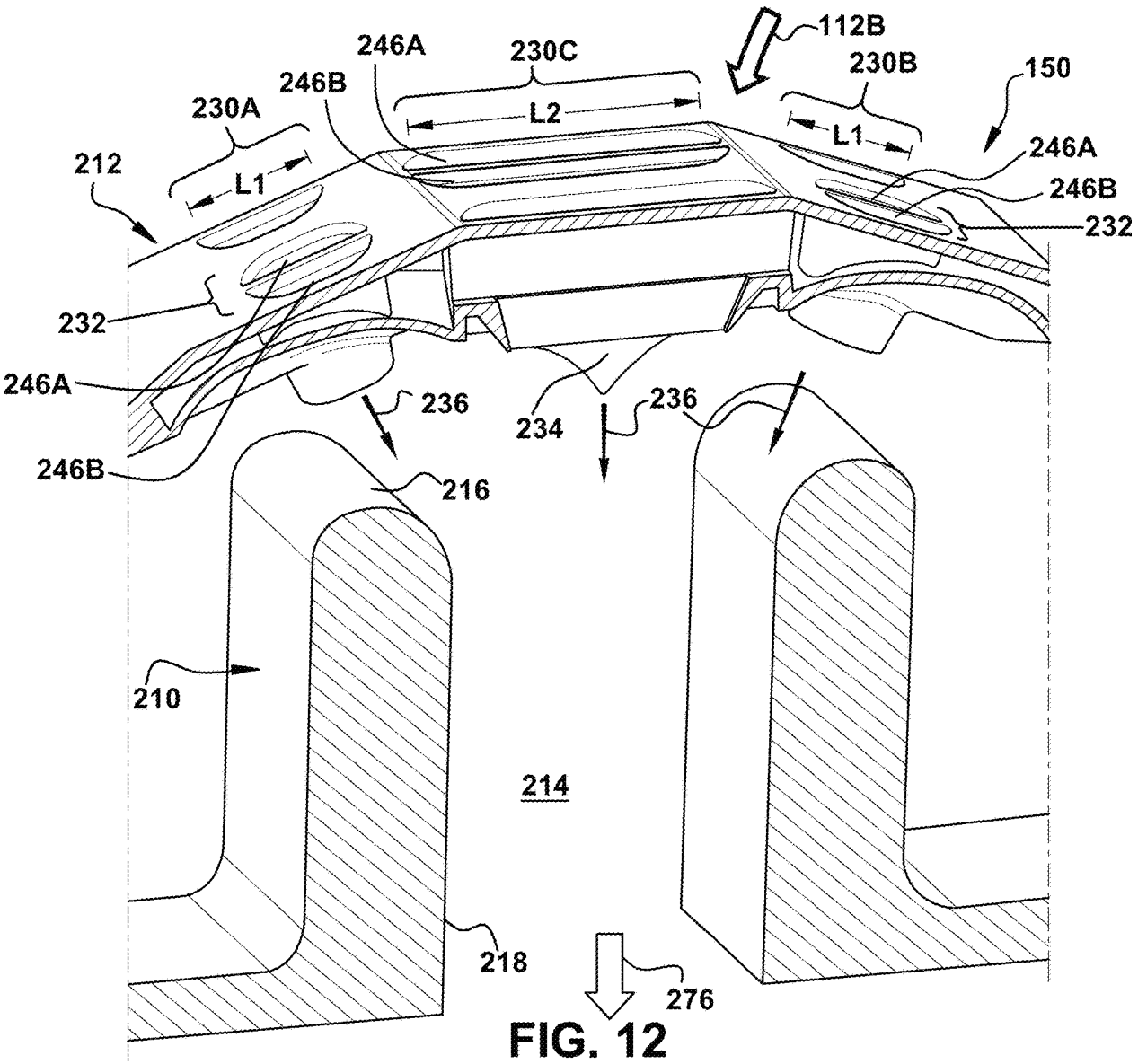
FIG. 12 shows an enlarged cross-sectional perspective view of an AFS injector according to other embodiments of the disclosure.

HP air-fuel injectors 232 and rows 230 thereof can take a variety of forms. To further illustrate the options, FIG. 11 shows an enlarged, perspective and cross-sectional view of HP air-fuel injection member 212 according to the FIGS. 3-6 embodiments, and FIG. 12 shows an enlarged, perspective and cross-sectional view of HP air-fuel injection member 212 according to an alternative embodiment. In addition, FIG. 13 shows a bottom view of HP air-fuel injection member 212, and FIG. 14 shows an enlarged bottom view of part of HP air-fuel injection member 212 according to embodiments of the disclosure.

Figure 14:
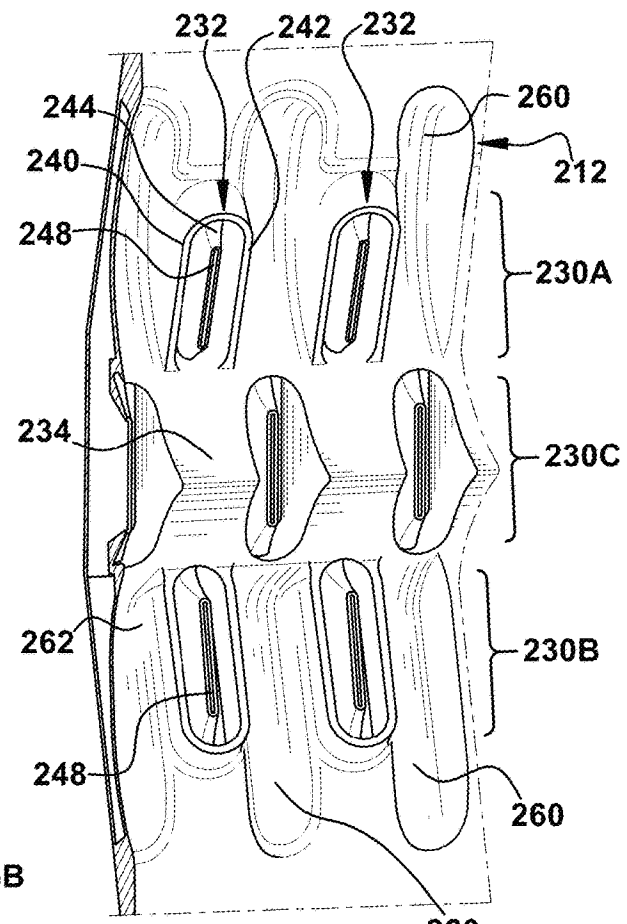
FIG. 14 shows an enlarged bottom view of a portion of a high-pressure air-fuel injection member of an AFS injector according to various embodiments of the disclosure.
Figure 13:
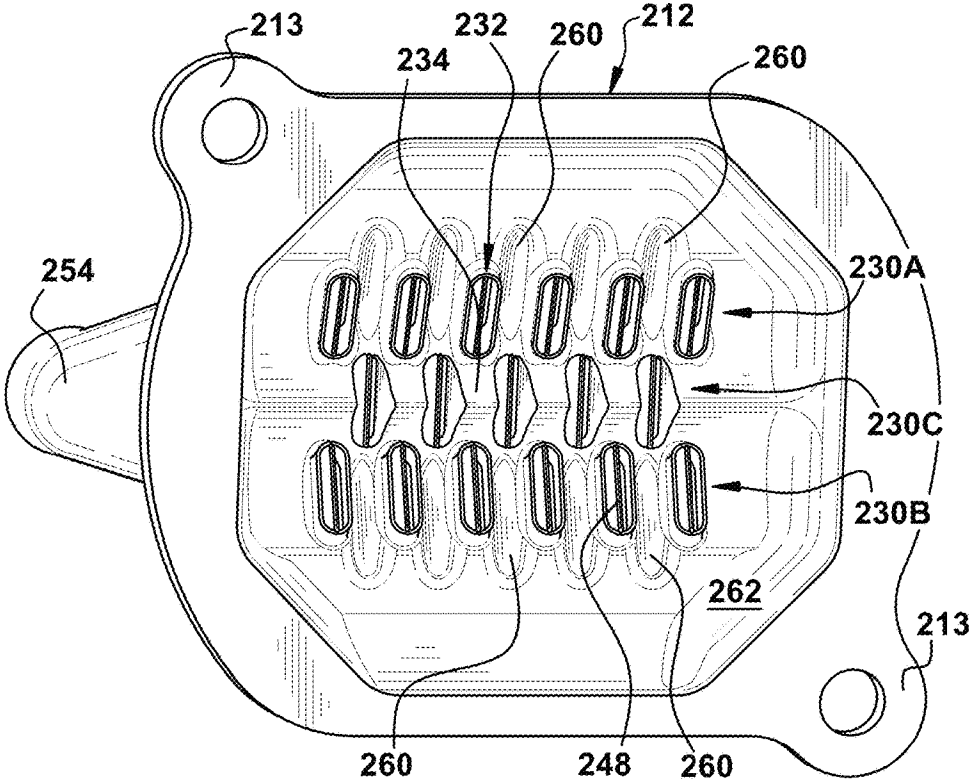
FIG. 13 shows a bottom view of a high-pressure air-fuel injection member of an AFS injector according to various embodiments of the disclosure.

In the example shown in FIGS. 3-6 and 11-14, where HP air-fuel injection member 212 includes two or more rows 230 (e.g., 230A-B or 230A-C) of HP air-fuel injectors 232, it may further include a tapered diversion wall 234 downstream and between an outlet of adjacent HP air jets 232 of first row 230A of HP air-fuel injectors 232 and second row 230B of HP air-fuel injectors 232. Where three rows 230A-C are provided, as shown in FIGS. 13 and 14, third row 230C of HP air-fuel injectors 232 may be axially offset from first row 230A of HP air-fuel injectors 232 and second row 230B of HP air-fuel injectors 232, and tapered diversion wall 234 may be downstream, i.e., closer to mixing chamber 214, and between an outlet of adjacent HP air jets 232 of first row 230A of HP air-fuel injectors 232 and second row 230B of HP air-fuel injectors 232. In any event, tapered diversion wall 234 acts to direct air-fuel mixture 236 exiting HP air-fuel injectors 232 toward a center of mixing chamber 214. HP air-fuel injection member 212 may also optionally include a diverging opening 256 (FIG. 4) downstream of each HP air-fuel injector 232 to encourage mixing of air and fuel. Opening 256 may also have other shapes, if desired, e.g., curved, parallel walls, etc.

The rows of HP air-fuel injectors 232 may be angled in any manner to encourage mixing of fuel 114B and HP 112B (and LP air 182 where provided) to form air-fuel mixture 236. In this regard, HP air-fuel injectors 232 of third row 230C of HP air-fuel injectors 232 may direct the air-fuel mixture 236 exiting therefrom in a direction parallel to mixing chamber 214. In contrast, as shown in FIG. 5, HP air-fuel injectors 232 of first row 230A and second row 230B may direct air-fuel mixture 236 exiting therefrom at an acute angle $\alpha 1$ or $\alpha 2$ to mixing chamber 214, respectively. The angles $\alpha 1$, $\alpha 2$ of rows 230A, 230B may be equal or different. In any event, rows 230 of HP air-fuel injectors 232 are aimed to direct air-fuel mixtures 236 exiting therefrom toward a center of mixing chamber 214. In addition, as shown in FIGS. 3-6, where LP air 182 is provided, rows 230 of HP air-fuel injectors 232 are aimed to direct air-fuel mixtures 236 exiting therefrom to draw LP air 182 into air-fuel mixture 236.

HP air-fuel injectors 232 may have any cross-sectional area necessary to achieve the desired air-fuel mixture 236. For example, as shown in FIGS. 3, 4, 6 and 11, where HP air jets 246 are elongated, HP air jets 246A-B of first, second and third rows 230A-C of HP air-fuel injectors 232 may have a same length L (FIG. 11). In other embodiments, HP air jets 246 may have different lengths in different rows 230 thereof. For example, as shown in FIG. 12, HP air jets 246A, 246B of third row 230C of HP air-fuel injectors 232 may be longer than HP air jets 246A, 246B of first row 230A and second row 230B of HP air-fuel injectors 232. That is, as shown in FIG. 12, L2>L1. In this manner, more air-fuel mixture 236 may be directed parallel to mixing chamber 214. Where HP air jets 246 have other cross-sectional shapes, the cross-sectional area of each jet in a given row may vary in a similar manner.

Figure 15:
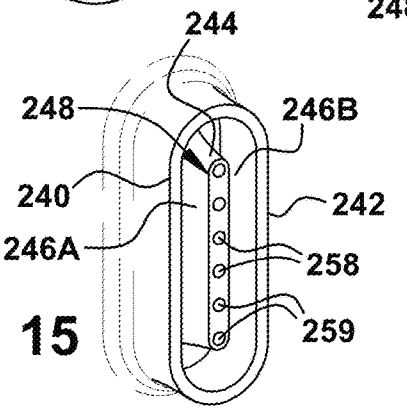
FIG. 15 shows an enlarged bottom view of a high-pressure air-fuel injection member of an AFS injector according to other embodiments of the disclosure.

Fuel injector 248 in middle wall 244 of each HP air-fuel injector 232 can take a variety of forms. As shown in FIGS. 10, 13 and 14, fuel injector 248 may include a single opening in the form of, for example, a slot. FIG. 15 shows a bottom view of an HP air-fuel injector 232 having a fuel injector 248 that includes plurality of fuel injectors 248, such as but not limited to a series of circular or slot openings. Where circular fuel injectors 248 are used fuel injectors 248 may be cylindrical openings or have narrowing, nozzle cross-sections to distribute fuel 114B. In any event, fuel injectors 248 may introduce fuel 114B into HP air 112B in any desired direction. For example, certain fuel injectors 248 in middle wall 244 may introduce fuel 114B toward HP air jet 246A and other fuel injectors 248 in middle wall 244 may introduce fuel 114B toward HP air jet 246B. In any event, the type, number, direction, spacing and size of fuel injectors 248 may be chosen depending on a wide variety of characteristics of, for example, combustor 100, HP air 112B, LP air 182, and/or fuel 114B. In terms of fuel 114B, for example, the characteristics may include but are not limited to: liquid or gas type, level of reactivity, viscosity, desired flow rate or volume, pressure, temperature, etc. Similar characteristics of air 112B, 182 may also be considered. In any event, other forms of fuel injectors 248 are also possible.

With reference to FIGS. 13-14, in certain embodiments that use LP air 182, a recess 260 may be defined in a radially inner wall 262 of HP air-fuel injection member 212 between adjacent HP air-fuel injectors 232 of each of first row 230A of HP air-fuel injectors 232 and second row 230B of HP air-fuel injectors 232. Recess 260 provides space for directing LP air 182 toward mixing chamber 214 and reduces pressure loss.

Figure 16:
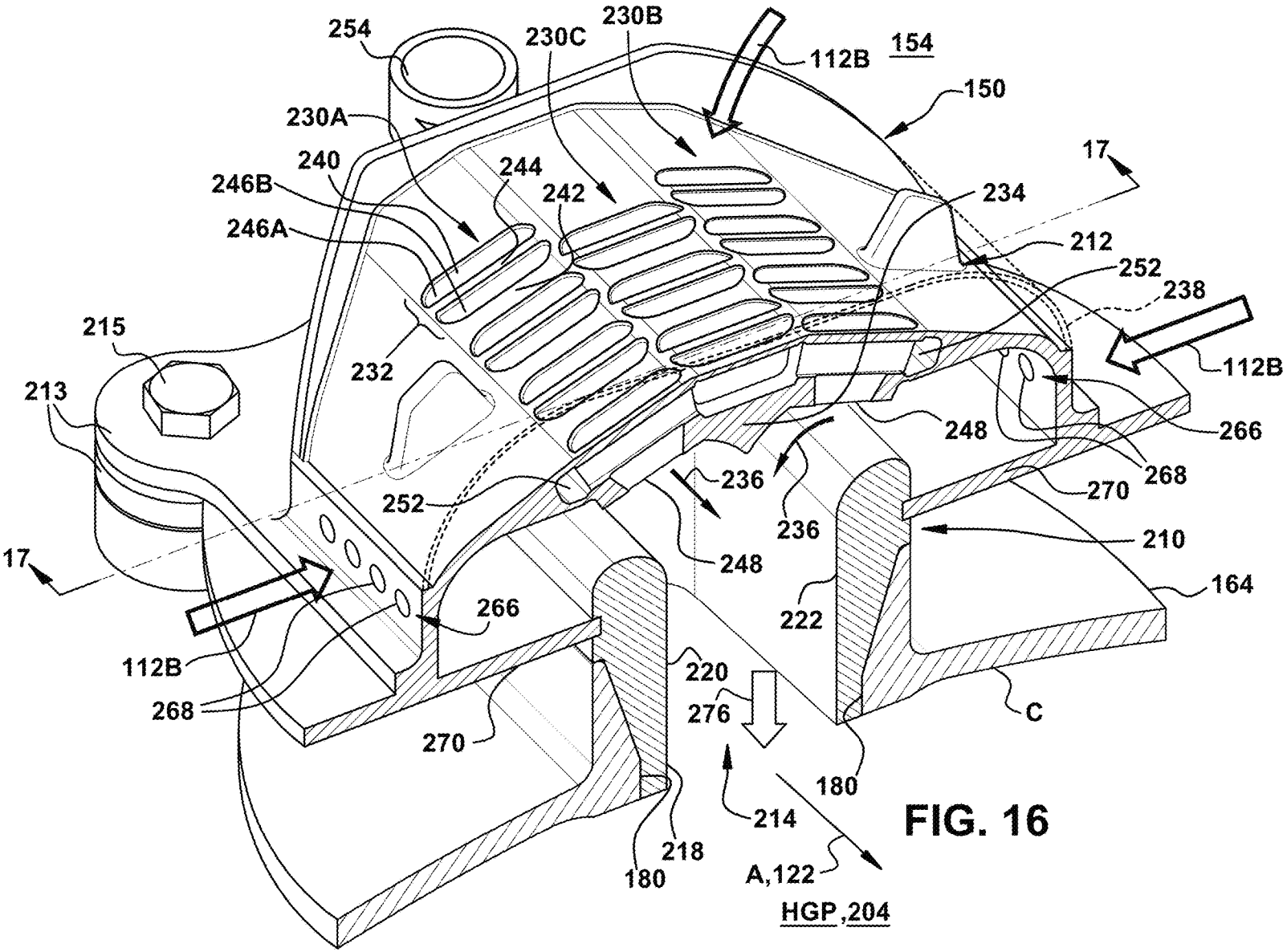
FIG. 16 shows a perspective and partial cross-sectional view of an AFS injector according to other embodiments of the disclosure.
Figure 17:
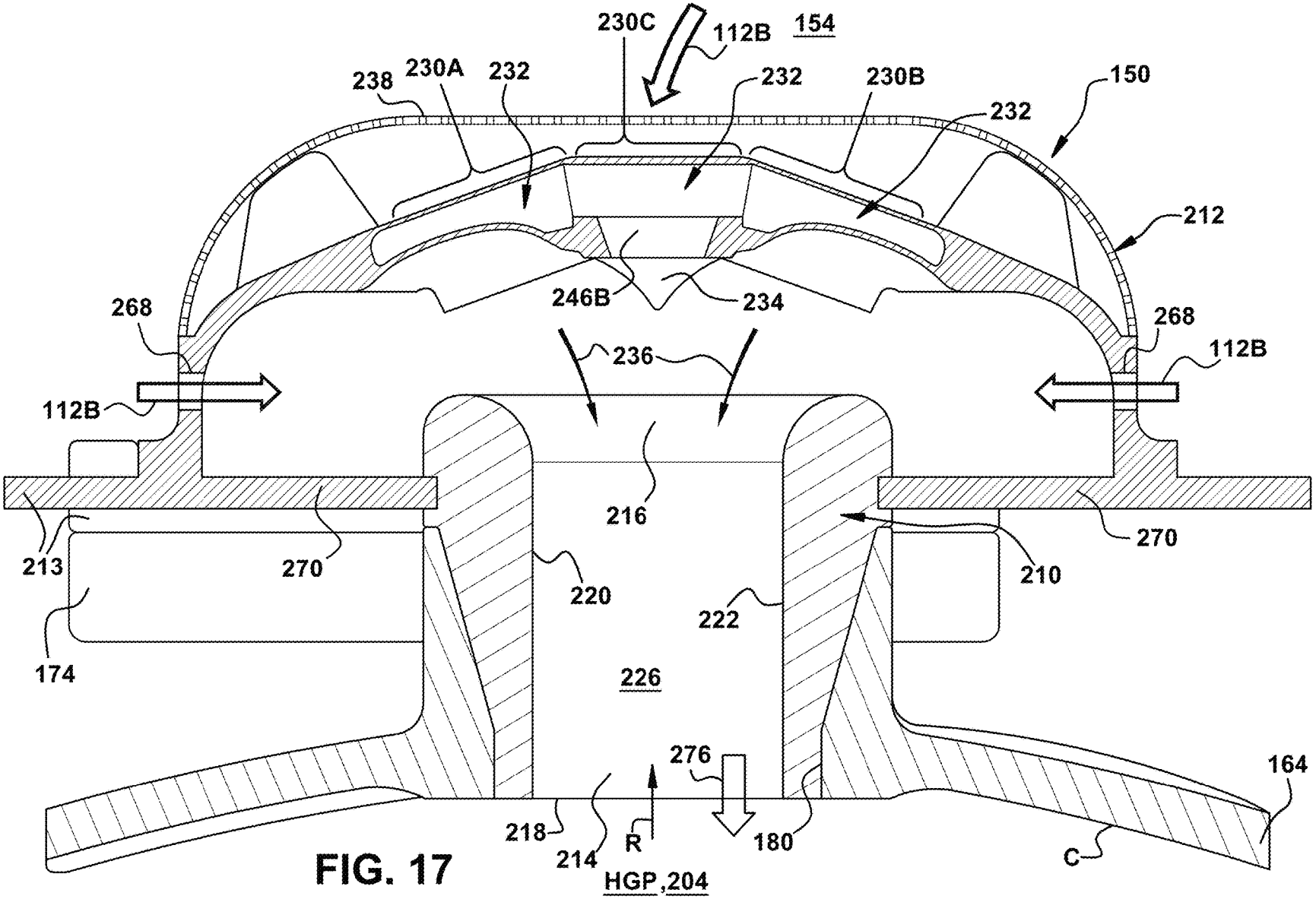
FIG. 17 shows a cross-sectional view of an AFS injector along view line 17-17 in FIG. 16 according to embodiments of the disclosure.

FIG. 16 shows a perspective and partial cross-sectional view, and FIG. 17 shows a cross-sectional view of AFS injector 150 along view line 17-17 in FIG. 16, according to other embodiments of the disclosure. In these embodiments, injection member 212 may further include at least one row 266 of HP air jet slots 268 circumferentially spaced from the at least one row of HP air-fuel injectors 232 for directing another HP air flow toward the inlet of the mixing chamber 214 from the HP air source 154. In this case, use of LP air 182 can be omitted by not providing fluid communication of AFS injector 150 with LP air source 184. FIGS. 16-17 also show not using LP air 182 as part of final air-fuel mixture 276 delivered from AFS injector 150. In this setting, mixing member 210 and/or injection member 212 may include a wall 270 that prevents any LP air 182 from entering mixing chamber 214. More particularly, wall 270 defines a sealed chamber 272 between mixing member 210 and injection member 212 that prevents any additional (i.e., LP) air from entering air-fuel mixture 236 exiting from HP air-fuel injectors 232.

With regard to operations, as shown in FIGS. 10, 16 and 17, each elongated HP air jet 246 is configured to direct HP air flow 112B toward inlet 216 of mixing chamber 214 from HP air source 154 in a same direction as fuel 114B flow from at least one fuel injector 248, and without any LP air 182. Fuel 114B does not need to penetrate HP air 112B flow, turn to enter the air flow or otherwise work to be mixed with it because the HP air 112B and fuel 114B are directed in the same direction by HP air-fuel injectors 232. Hence, low velocity regions and/or fuel rich concentration areas that can hold flame are omitted. HP air-fuel injectors 232 create a mixture of fuel 114B and HP air 112B without generating any of the afore-mentioned issues.

With regard to operations, as shown in FIGS. 3-6 and 10, HP air 112B flow may also draw LP air 182 from LP air source 184 to direct LP air 182 with HP air 112B into inlet 216 of mixing chamber 214, i.e., with fuel 114B as part of air-fuel mixture 236 entering mixing chamber 214. Hence, air-fuel mixture 236 entering mixing chamber (and air-fuel mixture 276 exiting mixing chamber 214) may include HP air 112B and fuel 114B, and may include LP air 182, where provided. It is noted that air-fuel mixture 236 (and 276) may be referenced as high-pressure despite the mixing with LP air 182 because it/they retains a relatively high pressure, although not as high as HP air 112B from HP air source 154, e.g., compressor discharge 109 (FIG. 2). Within mixing chamber 214, additional mixing of air 112B, 182 and fuel 114B occurs prior to air-fuel mixture 276 exiting AFS injector 150 into combustion liner 164 where it is combusted in secondary combustion zone 204.

AFS injector 150, i.e., mixing member 210 and injection member 212, may be made of any now known or later developed combustion tolerant and oxidation resistant materials. The material may be metal and can be a pure metal or an alloy. AFS injectors 150 may include a metal that is typically used in turbine components such as turbine blades or nozzles and that has a higher temperature and higher oxidation tolerance than materials typically used for combustion hardware. In this case, the material may include a non-reactive metal, e.g., made from a non-explosive or non-conductive powder, such as but not limited to: a cobalt chromium molybdenum (CoCrMo) alloy, stainless steel, an austenite nickel-chromium based alloy such as a nickel-chromium-molybdenum-niobium alloy (NiCrMoNb) (e.g., Inconel 625 or Inconel 718), a nickel-chromium-iron-molybdenum alloy (NiCrFeMo) (e.g., Hastelloy® X available from Haynes International, Inc.), a nickel-chromium-cobalt-molybdenum alloy (NiCrCoMo) (e.g., Haynes 233 or Haynes 282 available from Haynes International, Inc.), or a nickel-chromium-cobalt-titanium alloy (NiCrCoTi) (e.g., GTD 262 developed by General Electric Company). Other possibilities include, for example, René 108, CM 247, Mar M 247, and any precipitation harden-able (PH) nickel alloy.

Figure 18:
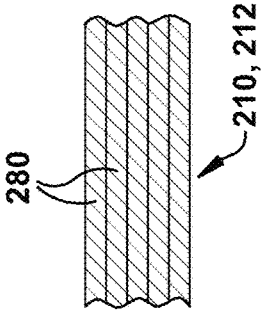
FIG. 18 shows a cross-sectional view of a plurality of parallel, sintered metal layers of a mixing member or a high-pressure air injection member of an AFS injector according to embodiments of the disclosure.
Figure 19:
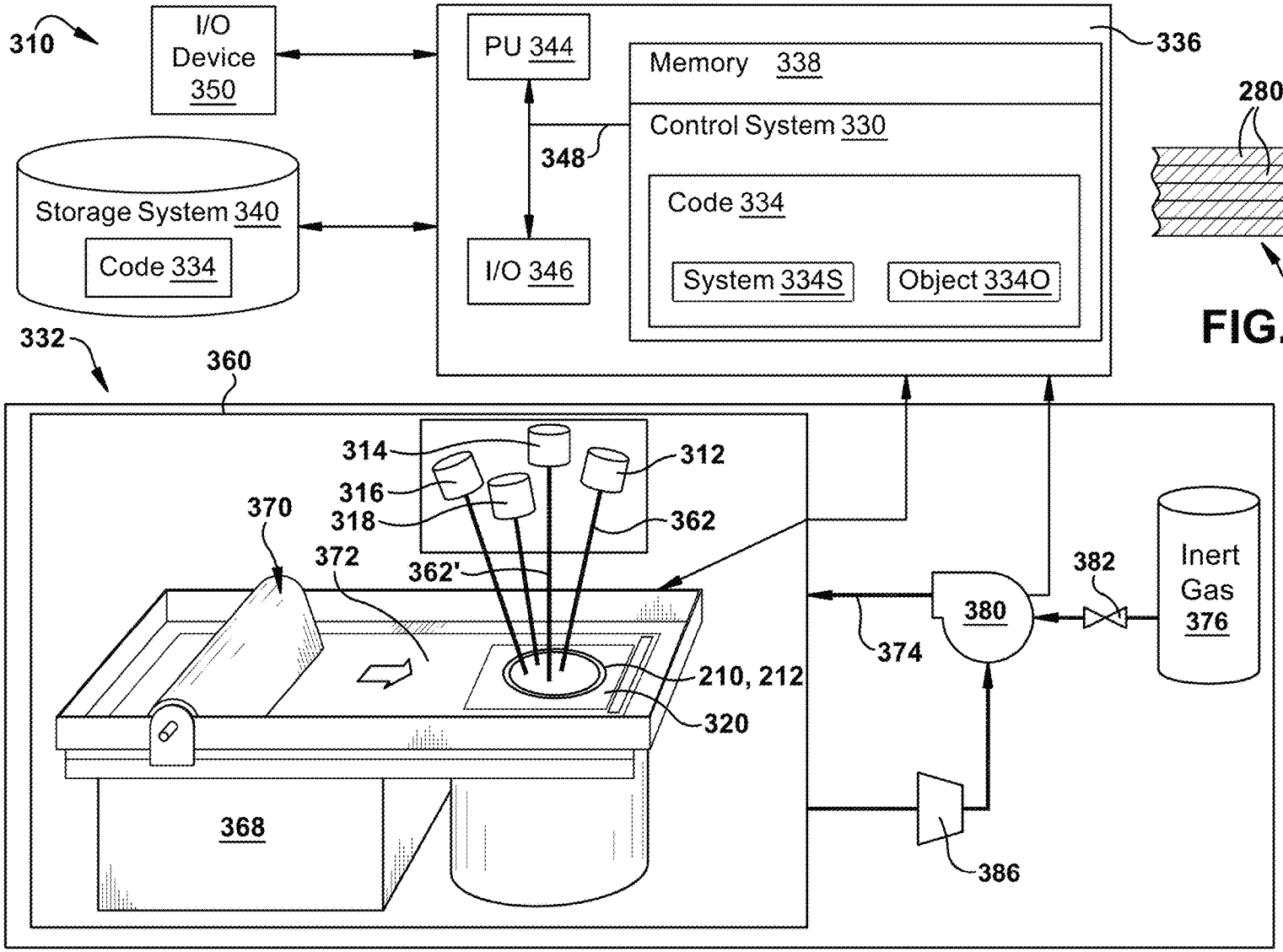
FIG. 19 shows a schematic block diagram of an illustrative additive manufacturing system for additively manufacturing a mixing member and/or a high-pressure air injection member of an AFS injector according to embodiments of the disclosure.

In certain embodiments, AFS injectors 150, i.e., mixing member 210 and/or injection member 212, may be additively manufactured using any now known or later developed technique capable of forming an integral body. Consequently, as shown in FIG. 18, mixing member 210 and/or injection member 212 includes a plurality of parallel, sintered metal layers 280. FIG. 19 shows a schematic/block view of an illustrative computerized metal powder additive manufacturing system 310 (hereinafter 'AM system 310') for generating AFS injector 150, i.e., mixing member 210 and/or injection member 212, of which only a single layer is shown. The teachings of the disclosures will be described relative to building mixing member 210 and/or injection member 212 using multiple melting beam sources 312, 314, 316, 318, but it is emphasized and will be readily recognized that the teachings of the disclosure are equally applicable to build mixing member 210 and/or injection member 212 using any number of melting beam sources. In this example, AM system 310 is arranged for direct metal laser melting (DMLM). It is understood that the general teachings of the disclosure are equally applicable to other forms of metal powder additive manufacturing such as but not limited to selective laser melting (SLM), and perhaps other forms of additive manufacturing (i.e., other than metal powder applications). The layer of mixing member 210 and/or injection member 212 in build platform 320 is illustrated as a circular element in FIG. 19; however, it is understood that the additive manufacturing process can be readily adapted to manufacture any shape on build platform 320.

AM system 310 generally includes an additive manufacturing control system 330 ("control system") and an AM printer 332. As will be described, control system 330 executes set of computer-executable instructions or code 334 to generate mixing member 210 and/or injection member 212 using multiple melting beam sources 312, 314, 316, 318. In the example shown, four melting beam sources may include four lasers. However, the teachings of the disclosures are applicable to any melting beam source, e.g., an electron beam, laser, etc. Control system 330 is shown implemented on computer 336 as computer program code. To this extent, computer 336 is shown including a memory 338 and/or storage system 340, a processor unit (PU) 344, an input/output (I/O) interface 346, and a bus 348. Further, computer 336 is shown in communication with an external I/O device/resource 350.

In general, processor unit (PU) 344 executes computer program code 334 that is stored in memory 338 and/or storage system 340. While executing computer program code 334, processor unit (PU) 344 can read and/or write data to/from memory 338, storage system 340, I/O device 350 and/or AM printer 332. Bus 348 provides a communication link between each of the components in computer 336, and I/O device 350 can comprise any device that enables a user to interact with computer 336 (e.g., keyboard, pointing device, display, etc.). Computer 336 is only representative of various possible combinations of hardware and software. For example, processor unit (PU) 344 may comprise a single processing unit or be distributed across one or more processing units in one or more locations, e.g., on a client and server. Similarly, memory 338 and/or storage system 340 may reside at one or more physical locations. Memory 338 and/or storage system 340 can comprise any combination of various types of non-transitory computer readable storage medium including magnetic media, optical media, random access memory (RAM), read only memory (ROM), etc. Computer 336 can comprise any type of computing device such as an industrial controller, a network server, a desktop computer, a laptop, a handheld device, etc.

As noted, AM system 310 and, in particular control system 330, executes code 334 to generate mixing member 210 and/or injection member 212. Code 334 can include, among other things, a set of computer-executable instructions 334S (herein also referred to as 'code 334S') for operating AM printer 332, and a set of computer-executable instructions 334O (herein also referred to as 'code 334O') defining mixing member 210 and/or injection member 212 to be physically generated by AM printer 332. As described herein, additive manufacturing processes begin with a non-transitory computer readable storage medium (e.g., memory 338, storage system 340, etc.) storing code 334. Set of computer-executable instructions 334S for operating AM printer 332 may include any now known or later developed software code capable of operating AM printer 332.

The set of computer-executable instructions 334O defining mixing member 210 and/or injection member 212 may include a precisely defined 3D model of mixing member 210 and/or injection member 212 and can be generated from any of a large variety of well-known computer aided design (CAD) software systems such as AutoCAD®, TurboCAD®, DesignCAD 3D Max, etc. In this regard, code 334O can include any now known or later developed file format. Furthermore, code 334O representative of mixing member 210 and/or injection member 212 may be translated between different formats. For example, code 334O may include Standard Tessellation Language (STL) files which was created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 334O representative of mixing member 210 and/or injection member 212 may also be converted into a set of data signals and transmitted, received as a set of data signals and converted to code, stored, etc., as necessary. Code 334O may be configured according to embodiments of the disclosure to allow for formation of border and internal sections in overlapping field regions, as will be described. In any event, code 334O may be an input to AM system 310 and may come from a part designer, an intellectual property (IP) provider, a design company, the operator or owner of AM system 310, or from other sources. In any event, control system 330 executes code 334S and 334O, dividing mixing member 210 and/or injection member 212 into a series of thin slices that assembles using AM printer 332 in successive layers of material.

AM printer 332 may include a processing chamber 360 that is sealed to provide a controlled atmosphere for mixing member 210 and/or injection member 212 printing. A build platform 320, upon which mixing member 210 and/or injection member 212 is/are built, is positioned within processing chamber 360. A number of melting beam sources 312, 314, 316, 318 are configured to melt layers of metal powder on build platform 320 to generate mixing member 210 and/or injection member 212. While four melting beam sources 312, 314, 316, 318 are illustrated, it is emphasized that the teachings of the disclosure are applicable to a system employing any number of sources, e.g., 1, 2, 3, or 5 or more. As understood in the field, each melting beam source 312, 314, 316, 318 may have a field including a non-overlapping field region, respectively, in which it can exclusively melt metal powder, and may include at least one overlapping field region in which two or more sources can melt metal powder. In this regard, each melting beam source 312, 314, 316, 318 may generate a melting beam, respectively, that fuses particles for each slice, as defined by code 334O. For example, in FIG. 19, melting beam source 312 is shown creating a layer of mixing member 210 and/or injection member 212 using melting beam 362 in one region, while melting beam source 314 is shown creating a layer of mixing member 210 and/or injection member 212 using melting beam 362' in another region.

Each melting beam source 312, 314, 316, 318 is calibrated in any now known or later developed manner. That is, each melting beam source 312, 314, 316, 318 has had its laser or electron beam's anticipated position relative to build platform 320 correlated with its actual position in order to provide an individual position correction (not shown) to ensure its individual accuracy. In one embodiment, each of plurality melting beam sources 312, 314, 316, 318 may create melting beams, e.g., 362, 362', having the same cross-sectional dimensions (e.g., shape and size in operation), power and scan speed.

Continuing with FIG. 19, an applicator (or re-coater blade) 370 may create a thin layer of raw material 372 spread out as the blank canvas from which each successive slice of the final mixing member 210 and/or injection member 212 will be created. Various parts of AM printer 332 may move to accommodate the addition of each new layer, e.g., a build platform 320 may lower and/or chamber 360 and/or applicator 370 may rise after each layer. The process may use different raw materials in the form of fine-grain metal powder, a stock of which may be held in a powder reservoir 368 accessible by applicator 370.

Processing chamber 360 is filled with an inert gas such as argon or nitrogen and controlled to minimize or eliminate oxygen. Control system 330 is configured to control a flow of a gas mixture 374 within processing chamber 360 from a source of inert gas 376. In this case, control system 330 may control a pump 380, and/or a flow valve system 382 for inert gas to control the content of gas mixture 374. Flow valve system 382 may include one or more computer controllable valves, flow sensors, temperature sensors, pressure sensors, etc., capable of precisely controlling flow of the particular gas. Pump 380 may be provided with or without valve system 382. Where pump 380 is omitted, inert gas may simply enter a conduit or manifold prior to introduction to processing chamber 360. Source of inert gas 376 may take the form of any conventional source for the material contained therein, e.g., a tank, reservoir or other source. Any sensors (not shown) required to measure gas mixture 374 may be provided. Gas mixture 374 may be filtered using a filter 386 in a conventional manner.

In operation, build platform 320 with metal powder thereon is provided within processing chamber 360, and control system 330 controls flow of gas mixture 374 within processing chamber 360 from source of inert gas 376. Control system 330 also controls AM printer 332, and in particular, applicator 370 and melting beam sources 312, 314, 316, 318 to sequentially melt layers of metal powder on build platform 320 to generate mixing member 210 and/or injection member 212 according to embodiments of the disclosure. While a particular AM system 310 has been described herein, it is emphasized that the teachings of the disclosure are not limited to any particular additive manufacturing system or method.

Once mixing member 210 and injection member 212 are formed, as shown in FIG. 2, they may be assembled to form AFS injector 150 with other parts of combustor 100. For example, as shown in FIGS. 3-5, mixing member 210 and/or injection member 212 may be bolted to AFS injector mounts 274 (FIGS. 3-5) therefor on combustion liner 164. More particularly, as noted, mixing member 210 and HP air-fuel injection member 212 may each include at least one mounting element 213 configured to receive fastener 215, e.g., bolt or weld, to couple mixing member 210 and HP air-fuel injection member 212 to combustion liner 164 that defines combustion chamber 172, i.e., to AFS injector mounts 274 of combustion liner 164.

Embodiments of the disclosure may also include combustor 100 for GT system 90. Combustor 100 includes combustor body 160 including combustion liner 164. Combustor 100 may also include a plurality of AFS injectors 150, as described herein, directed into combustion liner 164. Returning to FIG. 2, combustor 100 generally terminates at a point that is adjacent to a first stage 282 of stationary nozzles 284 of turbine 128. First stage 282 of stationary nozzles 284 at least partially defines turbine inlet 142 to turbine 128. Combustor body 160, i.e., combustion liner 164, at least partially defines a hot gas path (HGP) for routing combustion gases 122 from primary combustion zone 202 and secondary combustion zone 204 to turbine inlet 142 of turbine 128 during operation of GT system 90. Due to the small size of AFS injectors 150, they can be assembled onto combustion liner 164 of combustor body 160 (FIG. 2), and combustor body 160 can be installed in a generally axial direction into GT system 90 through the relatively small opening (not shown) in a compressor discharge casing (in casing 152).

Embodiments of the disclosure may also include, as shown in FIG. 1, GT system 90 including compressor section 110, combustion section 120 operatively coupled to compressor section 110, and turbine section 130 operatively coupled to combustion section 120. As described herein, combustion section 120 includes at least one combustor 100 including combustor body 160 including combustion liner 164, and head end fuel nozzle assembly 176 at a forward end of combustor body 160. Combustor 100 may also include a plurality of AFS injectors 150, as described herein, directed into combustor body 160, i.e., into combustion liner 164, downstream of head end assembly 176.

The disclosure provides various technical and commercial advantages, examples of which are discussed herein. As described herein, the AFS injector can accept high-pressure air and optionally low-pressure air, e.g., post-impingement cooling air, to reduce overall system pressure loss. The AFS injector can rapidly premix the air source(s) with, for example, highly reactive fuels, like hydrogen, to achieve low emissions, e.g., of nitrous oxide (NOx), with acceptable flame holding capability. The AFS injector provides high mixedness of fuel and air, minimizes flow-pressure loss, and prevents fuel from entering any low velocity air flow zones. Additionally, the AFS injector has a relatively small radial height from top to bottom, allowing the AFS injectors to be assembled onto the combustion liner of a combustor body, and the combustor body installed axially into the GT system through the relatively small opening in a compressor discharge casing.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately" or "about," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and its practical application and to enable others of ordinary skill in the art to understand the disclosure for envisioning embodiments with various modifications as are suited to the particular use contemplated.

What is claimed is:

1. An axial fuel stage (AFS) injector for a combustor of a gas turbine (GT) system, the AFS injector comprising:

a mixing member including a mixing chamber defined therein, the mixing chamber having an inlet and an outlet, wherein the outlet is configured to be in fluid communication with a combustion chamber of the combustor; and a high pressure (HP) air-fuel injection member including at least one row of HP air-fuel injectors for directing an air-fuel mixture into the mixing chamber, each HP air-fuel injector including:

two opposing sidewalls and a middle wall extending longitudinally between the two opposing sidewalls, the middle wall and each opposing sidewall defining an elongated high pressure (HP) air jet therebetween;

at least one fuel injector defined in a radially inner end of the middle wall; and a fuel plenum defined in the middle wall, the fuel plenum configured to deliver fuel from a fuel source to each of the at least one fuel injector, wherein each elongated HP air jet is configured to direct an HP air flow toward the inlet of the mixing chamber from an HP air source in a same direction as a fuel flow from the at least one fuel injector.

2. The AFS injector of claim 1, wherein the at least one row of HP air-fuel injectors includes a first row of HP air-fuel injectors and a second row of HP air-fuel injectors, and the HP air-fuel injection member further includes a tapered diversion wall downstream and between an outlet of adjacent HP air jets of the first row of HP air-fuel injectors and the second row of HP air-fuel injectors.

3. The AFS injector of claim 1, wherein the at least one row of HP air-fuel injectors includes a first row of HP air-fuel injectors, a second row of HP air-fuel injectors and a third row of HP air-fuel injectors between the first row and second row of HP air-fuel injectors.

4. The AFS injector of claim 3, wherein the HP air-fuel injectors of the third row of HP air-fuel injectors direct the air-fuel mixture in a direction parallel to the mixing chamber, and the HP air-fuel injectors of the first row and the second row direct the air-fuel mixture at an acute angle to the direction parallel to the mixing chamber.

5. The AFS injector of claim 3, wherein the HP air jets of the third row of HP air-fuel injectors are longer in a transverse direction, relative to an axial direction of the AFS injector, than the HP air jets of the first row and the second row of HP air-fuel injectors.

6. The AFS injector of claim 3, wherein the HP air jets of the first, second and third rows of HP air-fuel injectors have a same length in a transverse direction, relative to an axial direction of the AFS injector.

7. The AFS injector of claim 3, wherein the third row of HP air-fuel injectors is axially offset from the first row of HP air-fuel injectors and the second row of HP air-fuel injectors, and the HP air-fuel injection member further includes a tapered diversion wall downstream and between an outlet of adjacent HP air jets of the first row of HP air-fuel injectors and the second row of HP air-fuel injectors.

8. The AFS injector of claim 7, further comprising a recess defined in a radially inner wall of the HP air-fuel injection member between a plurality of adjacent HP air-fuel injectors of at least one of the first row of HP air-fuel injectors and the second row of HP air-fuel injectors.

9. The AFS injector of claim 1, wherein the HP air-fuel injection member further includes at least one row of HP air jet slots circumferentially spaced from the at least one row of HP air-fuel injectors for directing another HP air flow toward the inlet of the mixing chamber from the HP air source.

10. The AFS injector of claim 1, wherein the HP air-fuel injection member includes a diverging opening downstream of each HP air-fuel injector.

11. The AFS injector of claim 1, wherein the two opposing sidewalls and the middle wall are connected at longitudinal ends thereof, wherein the two opposing sidewalls collectively have an elliptical cross-sectional shape.

12. The AFS injector of claim 1, wherein the middle wall has a tear drop cross-sectional shape having a bulbous end and a tip end, and the at least one fuel injector is in the tip end.

13. The AFS injector of claim 1, wherein the at least one fuel injector includes a plurality of fuel injectors.

14. The AFS injector of claim 1, wherein the fuel plenum defined in the middle wall extends from one end of the middle wall to an opposing end of the middle wall.

15. The AFS injector of claim 1, wherein the HP air flow also draws a low pressure (LP) air from a LP air source to direct the LP air with the HP air into the inlet of the mixing chamber.

16. The AFS injector of claim 15, wherein the HP air source is in direct fluid communication with a compressor discharge of the GT system, and the LP air source is in fluid communication with a cooling passage defined along at least a portion of a combustion liner of the combustor.

17. The AFS injector of claim 1, wherein the mixing member and the HP air-fuel injection member each include at least one mounting element configured to receive a fastener to couple the mixing member and the HP air-fuel injection member to a combustion liner that defines the combustion chamber.

18. A combustor for a gas turbine system, the combustor comprising:

a combustor body including a combustion liner; and a plurality of axial fuel stage (AFS) injectors directed into the combustion liner, each AFS injector including:

a mixing member including a mixing chamber defined therein, the mixing chamber having an inlet and an outlet, wherein the outlet is configured to be in fluid communication with a combustion chamber of the combustor; and a high pressure (HP) air-fuel injection member including at least one row of HP air-fuel injectors for directing an air-fuel mixture into the mixing chamber, each HP air-fuel injector including:

two opposing sidewalls and a middle wall extending longitudinally between the two opposing sidewalls, the middle wall and each opposing sidewall defining an elongated high pressure (HP) air jet therebetween;

at least one fuel injector defined in a radially inner end of the middle wall; and a fuel plenum defined in the middle wall, the fuel plenum configured to deliver fuel from a fuel source to each of the at least one fuel injector, wherein each elongated HP air jet is configured to direct an HP air flow toward the inlet of the mixing chamber from an HP air source in a same direction as a fuel flow from the at least one fuel injector.

19. The combustor of claim 18, wherein the at least one row of HP air-fuel injectors includes a first row of HP air-fuel injectors, a second row of HP air-fuel injectors and a third row of HP air-fuel injectors between the first row and second row of HP air-fuel injectors.

20. A gas turbine (GT) system, comprising:

a compressor section;

a combustion section operatively coupled to the compressor section; and a turbine section operatively coupled to the combustion section, wherein the combustion section includes at least one combustor including:

a combustor body including a combustion liner;

a head end fuel nozzle assembly at a forward end of the combustor body; and a plurality of axial fuel stage (AFS) injectors directed into the combustor body downstream of the head end fuel nozzle assembly, each AFS injector including:

a mixing member including a mixing chamber defined therein, the mixing chamber having an inlet and an outlet, wherein the outlet is configured to be in fluid communication with a combustion chamber of the combustor; and a high pressure (HP) air-fuel injection member including at least one row of HP air-fuel injectors for directing an air-fuel mixture into the mixing chamber, each HP air-fuel injector including:

two opposing sidewalls and a middle wall extending longitudinally between the two opposing sidewalls, the middle wall and each opposing sidewall defining an elongated high pressure (HP) air jet therebetween;

at least one fuel injector defined in a radially inner end of the middle wall; and a fuel plenum defined in the middle wall, the fuel plenum configured to deliver fuel from a fuel source to each of the at least one fuel injector, wherein each elongated HP air jet is configured to direct an HP air flow toward the inlet of the mixing chamber from an HP air source in a same direction as a fuel flow from the at least one fuel injector.

* * * * *